US007600901B2

(12) United States Patent
Gordin et al.

(10) Patent No.: US 7,600,901 B2
(45) Date of Patent: Oct. 13, 2009

(54) APPARATUS AND METHOD FOR COMPENSATING FOR CROSS-ARM WARPAGE WHEN PRE-AIMING LIGHTING FIXTURES AT FACTORY

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 11/333,883

(22) Filed: Jan. 18, 2006

(65) Prior Publication Data

US 2006/0176698 A1 Aug. 10, 2006

Related U.S. Application Data

(60) Provisional application No. 60/644,687, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005.

(51) Int. Cl.
*F21S 8/00* (2006.01)

(52) U.S. Cl. ..... 362/431; 362/427; 248/519; 52/741.14; 174/45 R; 33/286

(58) Field of Classification Search ..... 362/427, 362/428, 431; 248/519; 52/741.14; 174/45 R; 33/286

See application file for complete search history.

(56) References Cited

U.S. PATENT DOCUMENTS 2,447,923 A 8/1948 Tuck
4,450,507 A * 5/1984 Gordin ..... 362/427

(Continued)

FOREIGN PATENT DOCUMENTS

EP 1 172 839 A2 1/2002

*Primary Examiner*—Stephen F Husar
(74) *Attorney, Agent, or Firm*—McKee, Voorhees & Sease, P.L.C.

(57) ABSTRACT

A method for compensating for warpage or other variations in a cross arm on a pole adopted for the mounting of lighting fixtures at predetermined aiming angles relative to a target space on an adjustable mounting structure comprises designing an angular orientation of the fixture relative to a cross arm based on pre-determined assumptions of the geometry of the cross arm; after installation of the lighting fixture on the cross arm, checking for any variation from the assumed geometry; compensating for any variation in actual geometry when finally aiming the fixture to its target location.

19 Claims, 38 Drawing Sheets

U.S. PATENT DOCUMENTS

| | | | | |
|---|---|---|---|---|
| 4,816,974 | A | 3/1989 | Gordin | |
| 4,947,303 | A | 8/1990 | Gordin et al. | |
| 5,161,883 | A | 11/1992 | Gordin et al. | |
| 5,600,537 | A | 2/1997 | Gordin et al. | |
| 5,816,691 | A | 10/1998 | Gordin et al. | |
| 5,856,721 | A | 1/1999 | Gordin et al. | |
| 6,036,338 | A | 3/2000 | Gordin | |
| 6,203,176 | B1 | 3/2001 | Gordin | |
| 6,705,744 | B2 * | 3/2004 | Hubbell et al. | 362/250 |
| 6,833,675 | B2 | 12/2004 | Gordin | |
| 7,033,044 | B2 * | 4/2006 | Griffin | 362/250 |
| 7,232,236 | B2 * | 6/2007 | Vitense et al. | 362/153 |

* cited by examiner

Figure 1A:
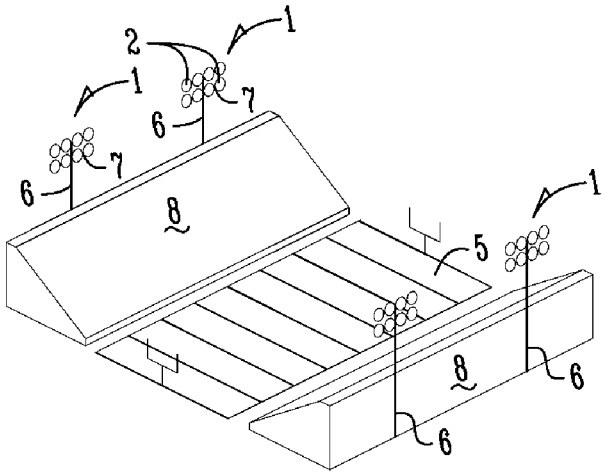
Figure 1B:
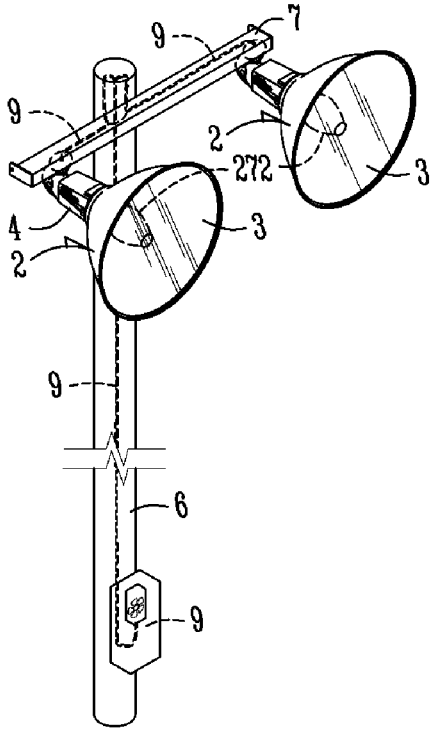
Figure 1C:
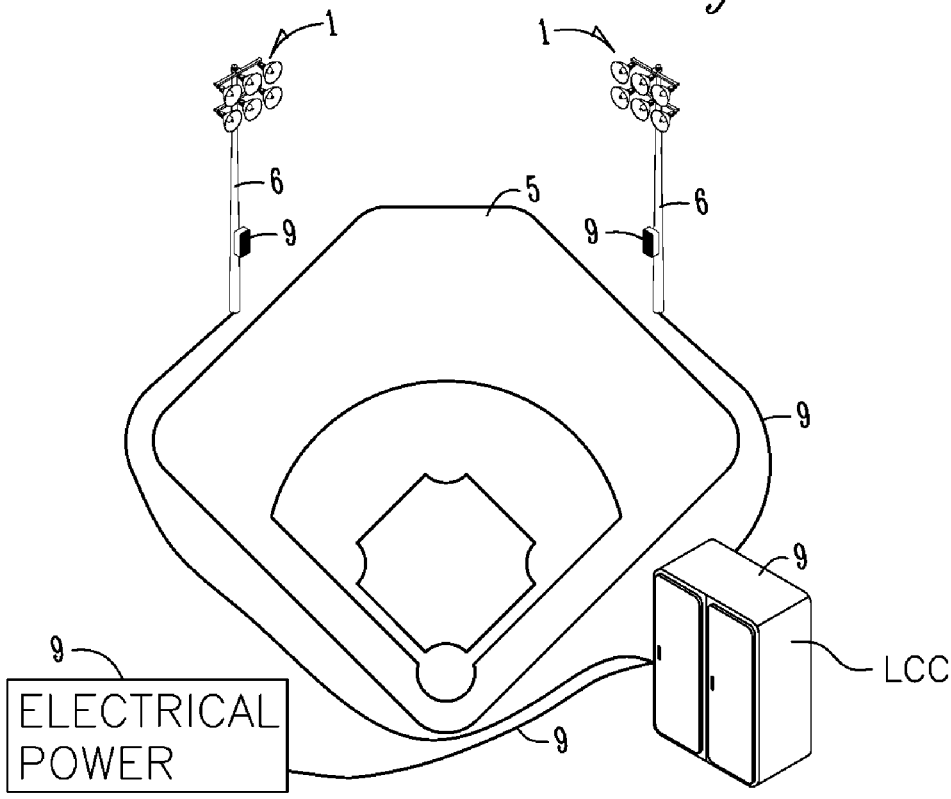

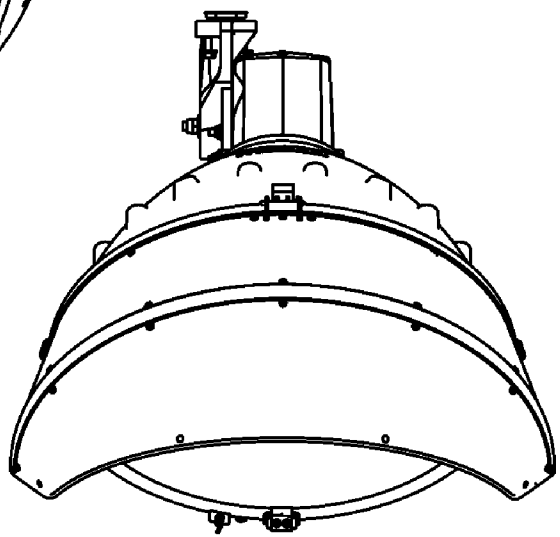
Fig. 3G1A
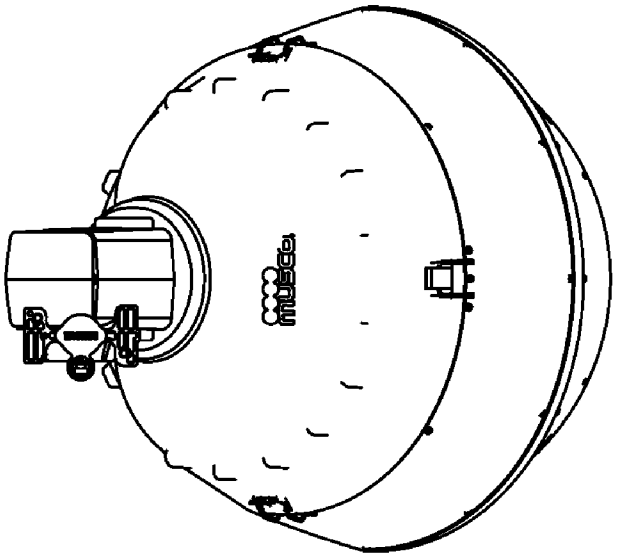
Fig. 3G1C
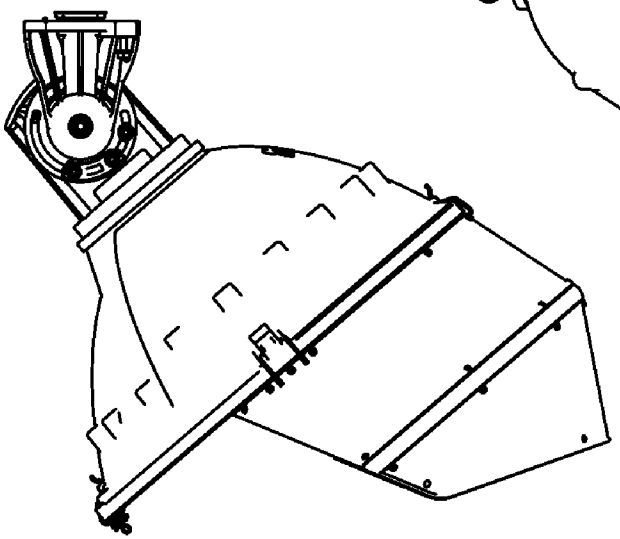
Fig. 3G1B

Figure 2:
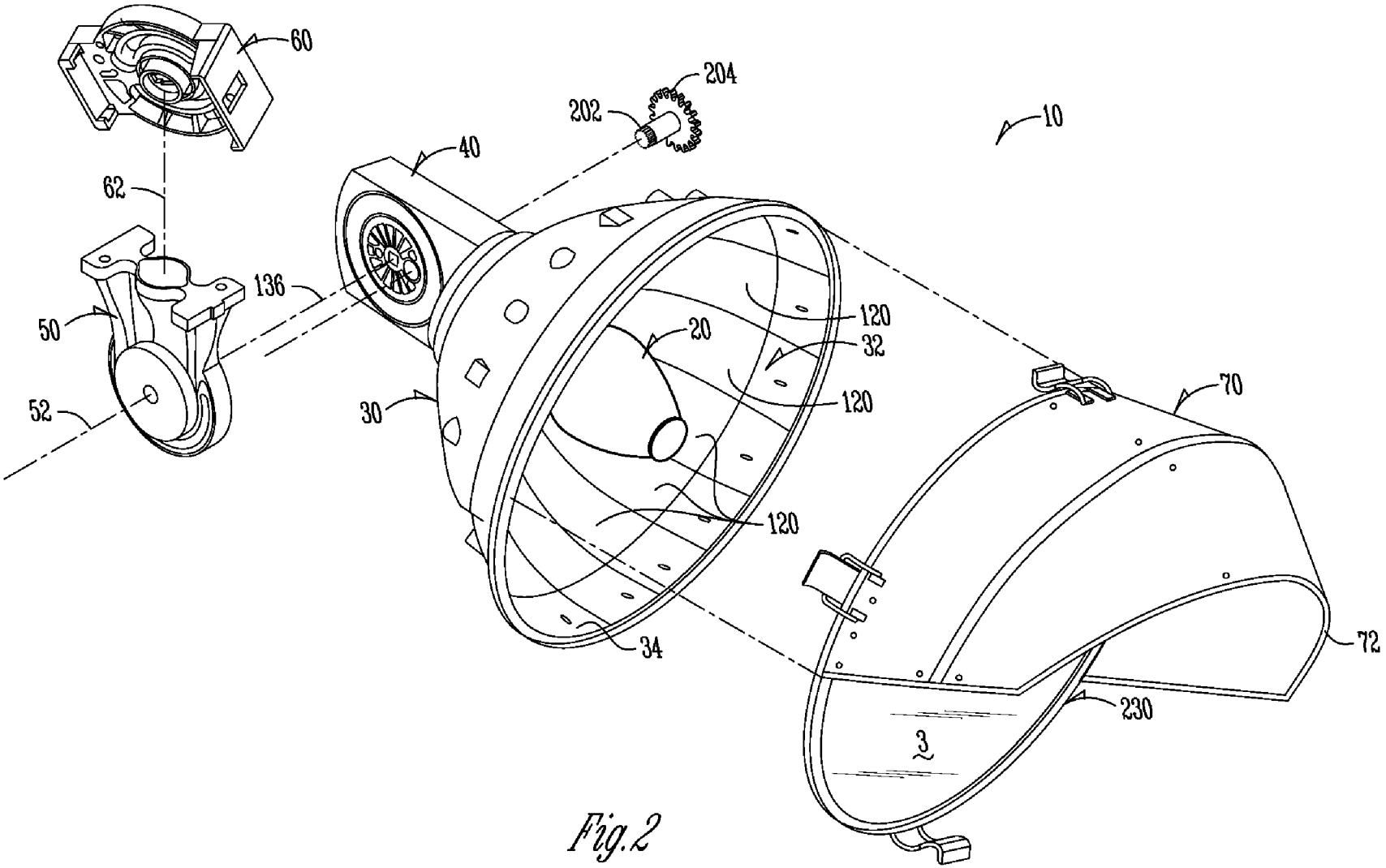
Figure 3A:
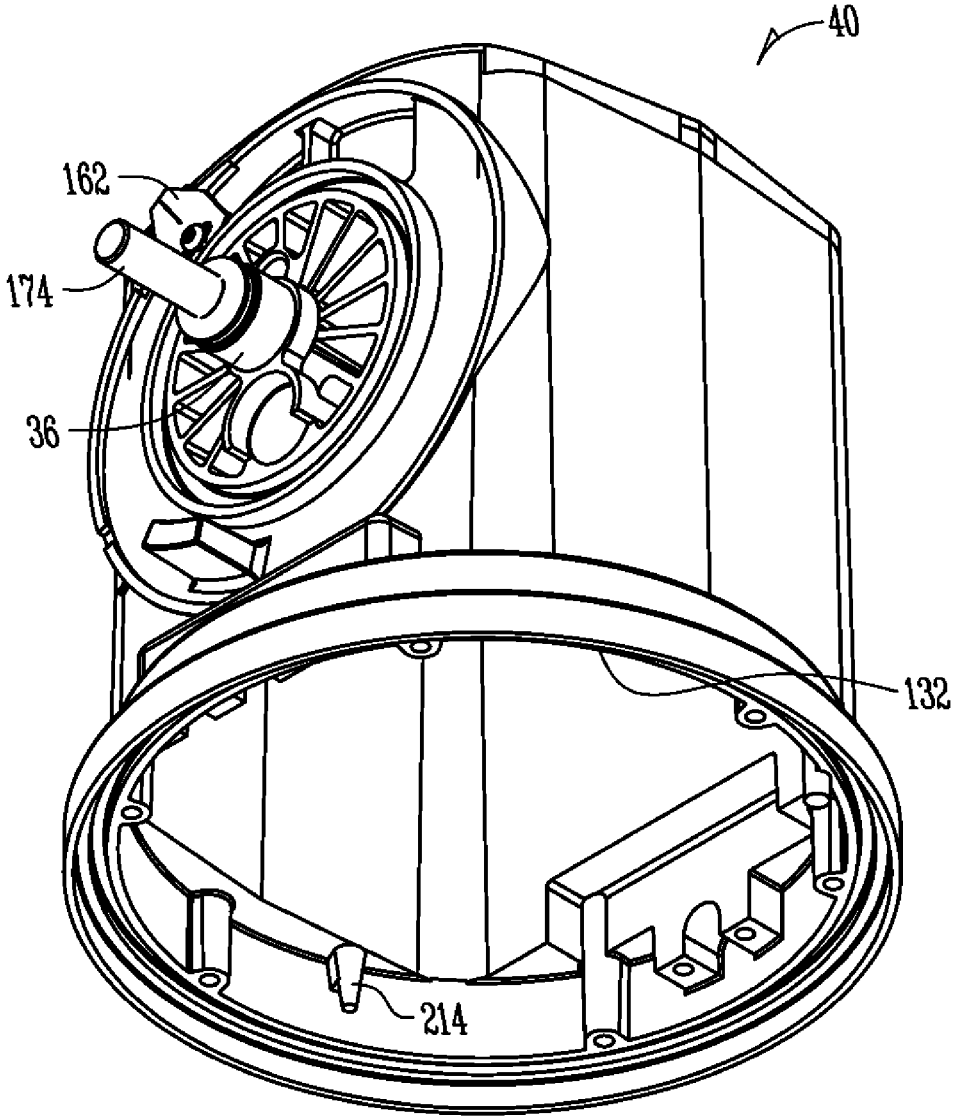
Figure 3B:
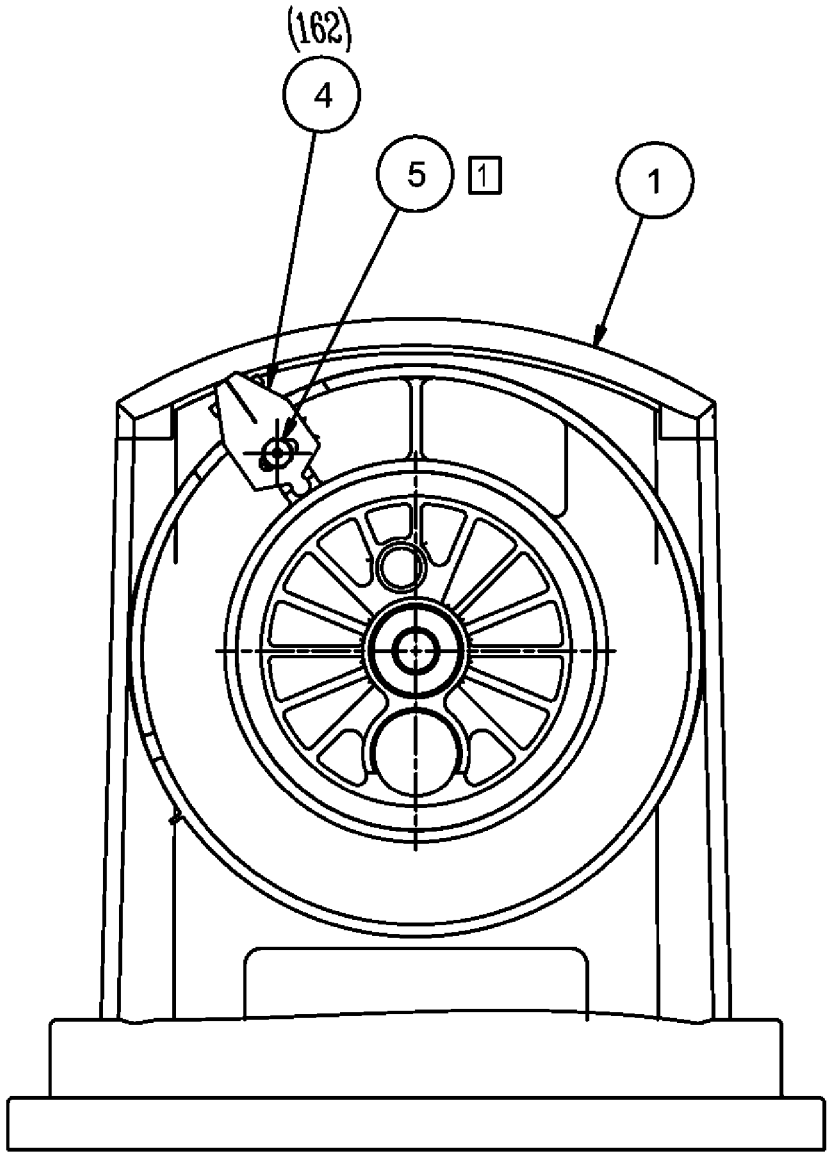
Figure 3C:
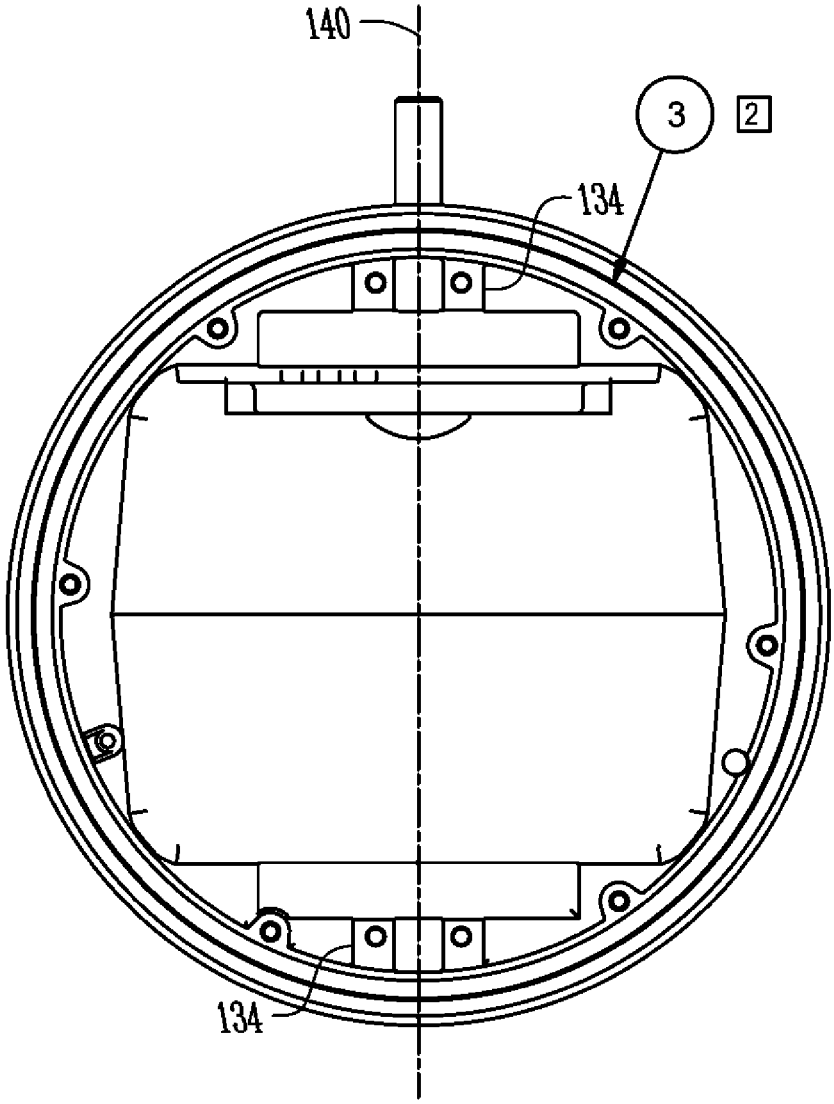
Figure 3D:
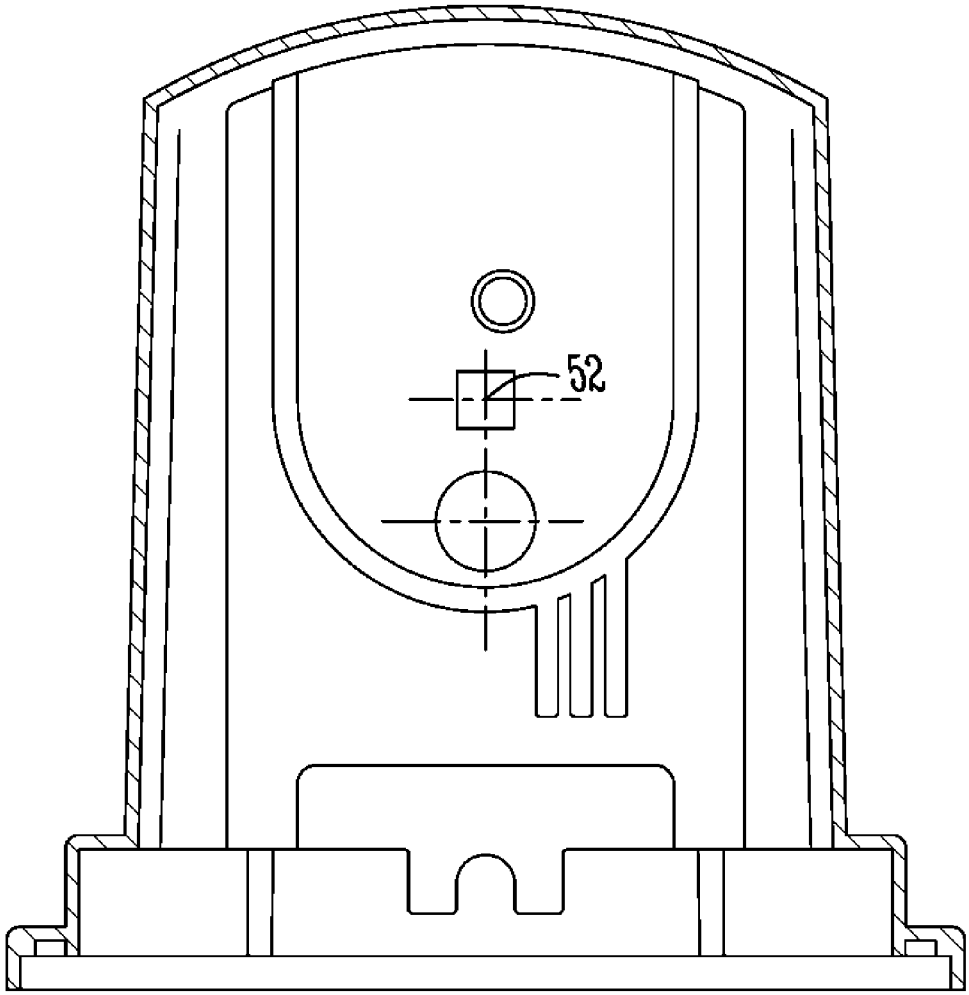
Figure 3E:
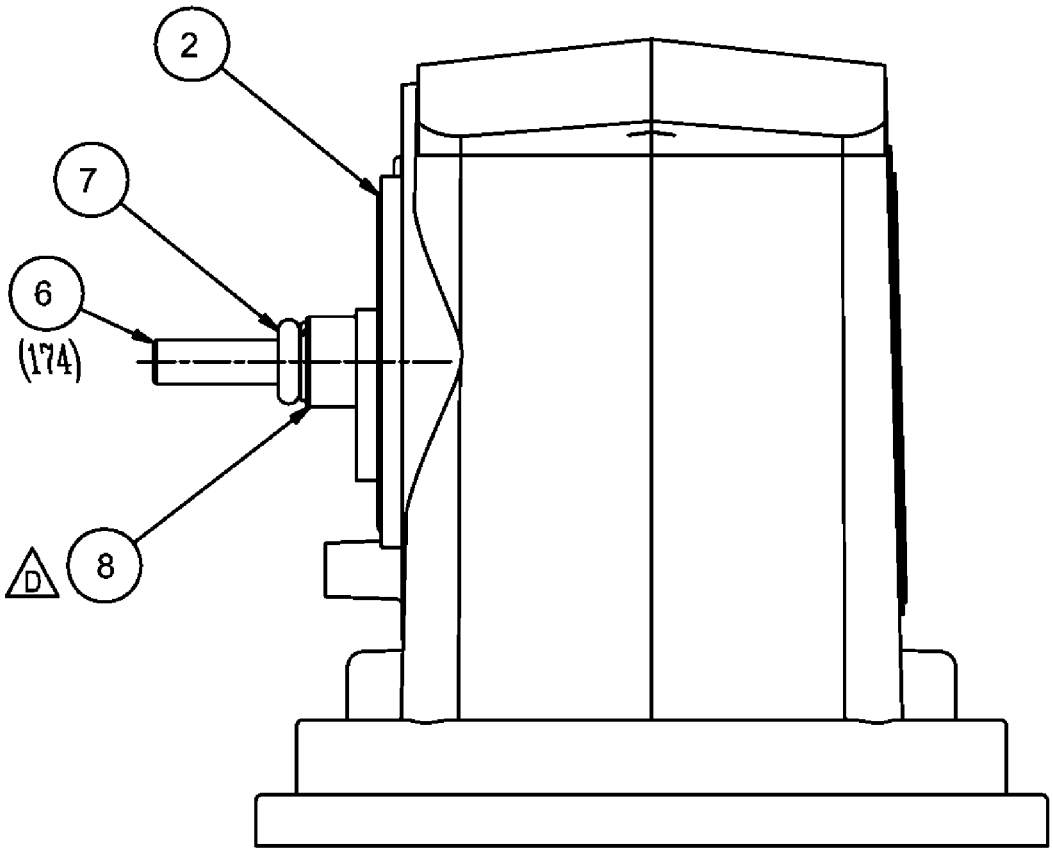
Figure 3F:
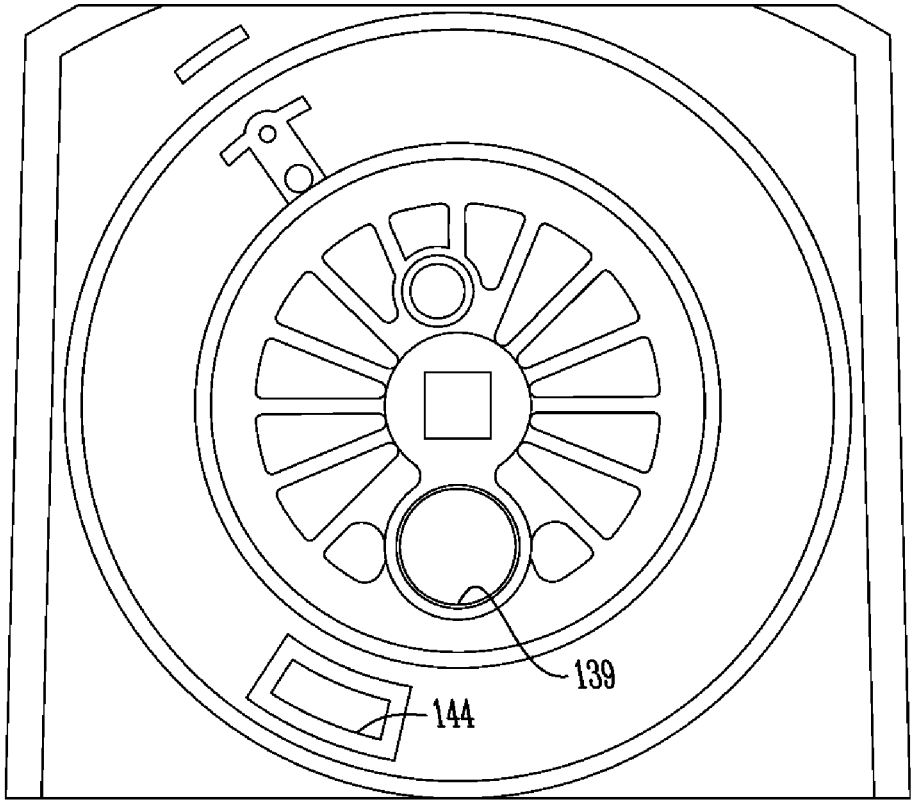
Figure 3H:
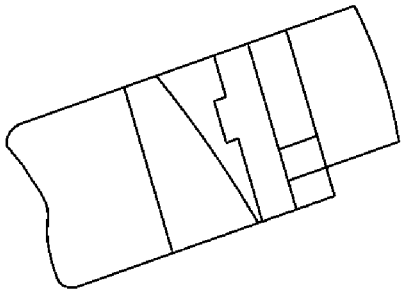
Figure 3I:
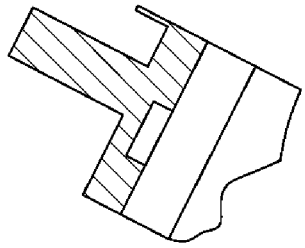

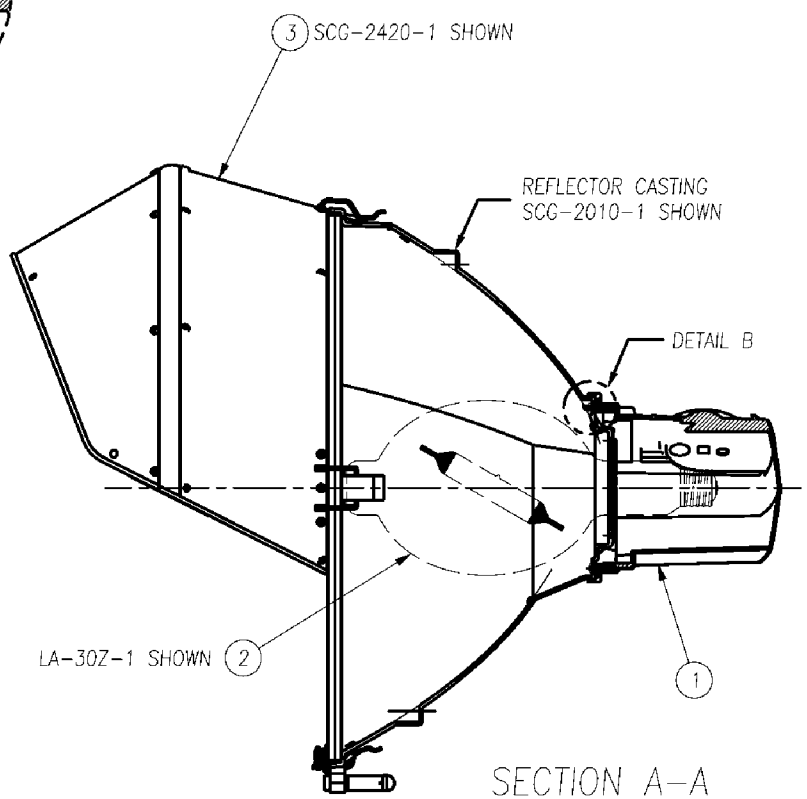
Fig. 3C2B
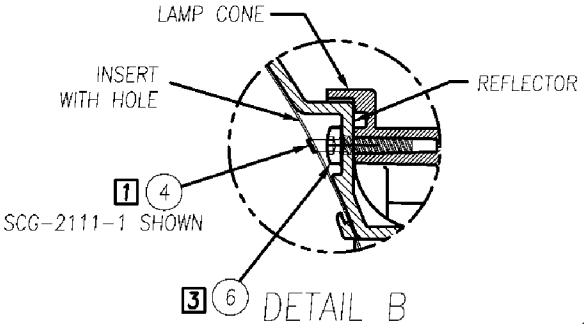
Fig. 3C2C
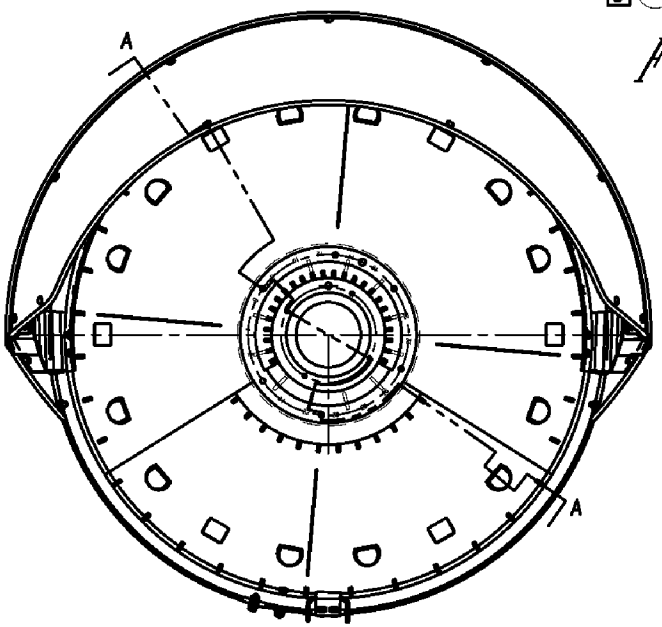
Fig. 3C2A

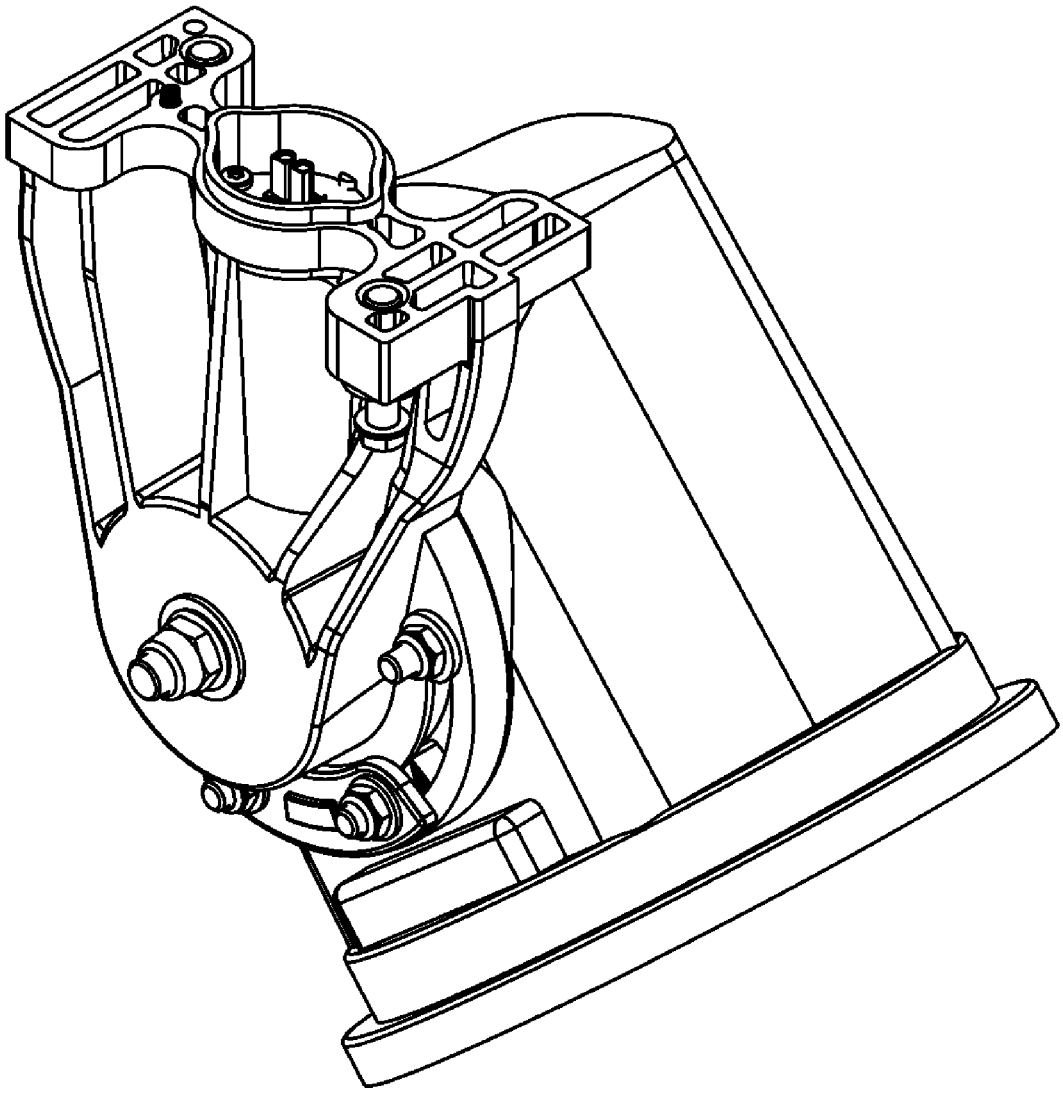
Fig. 3J1

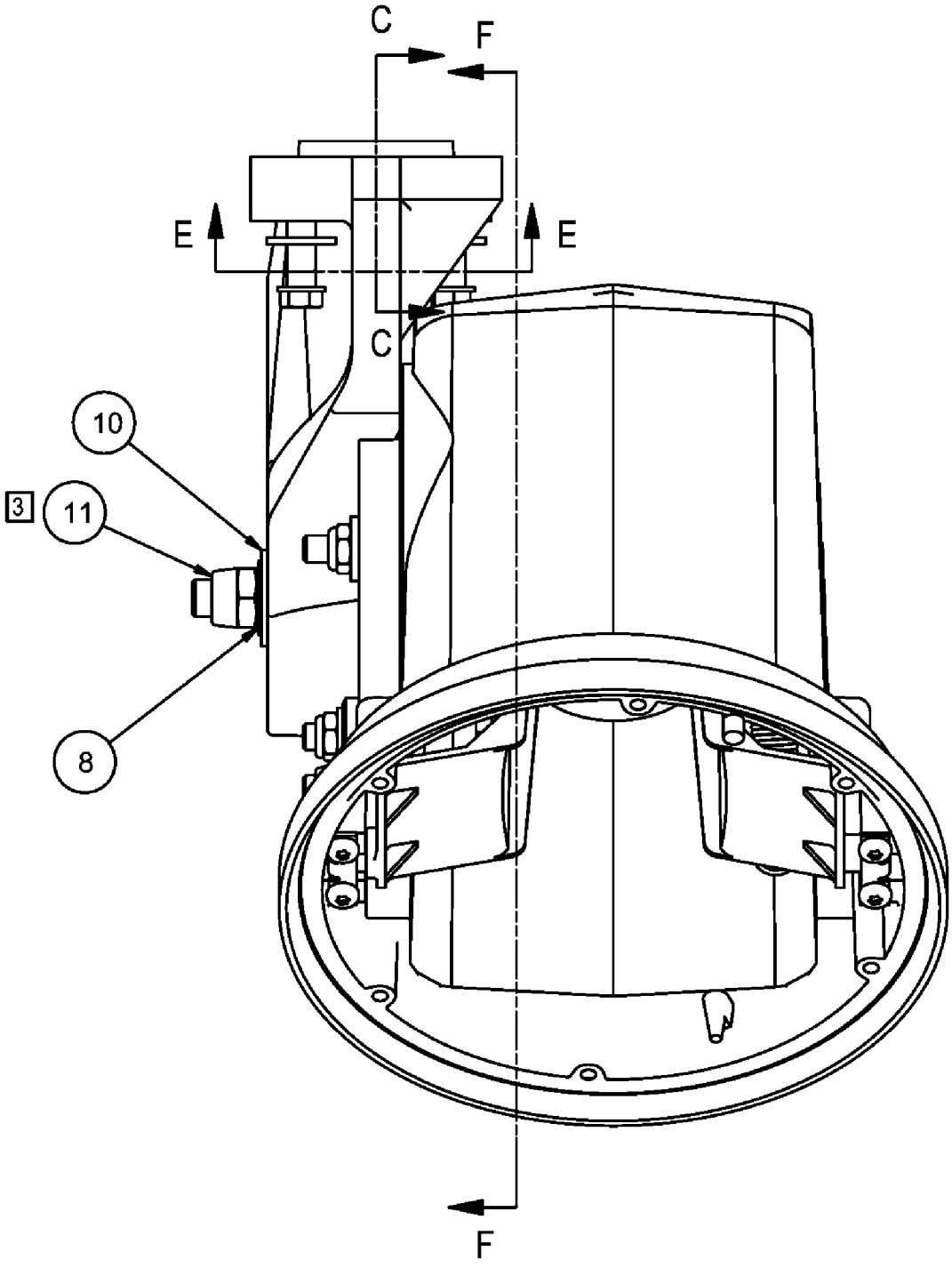
Fig. 3J2

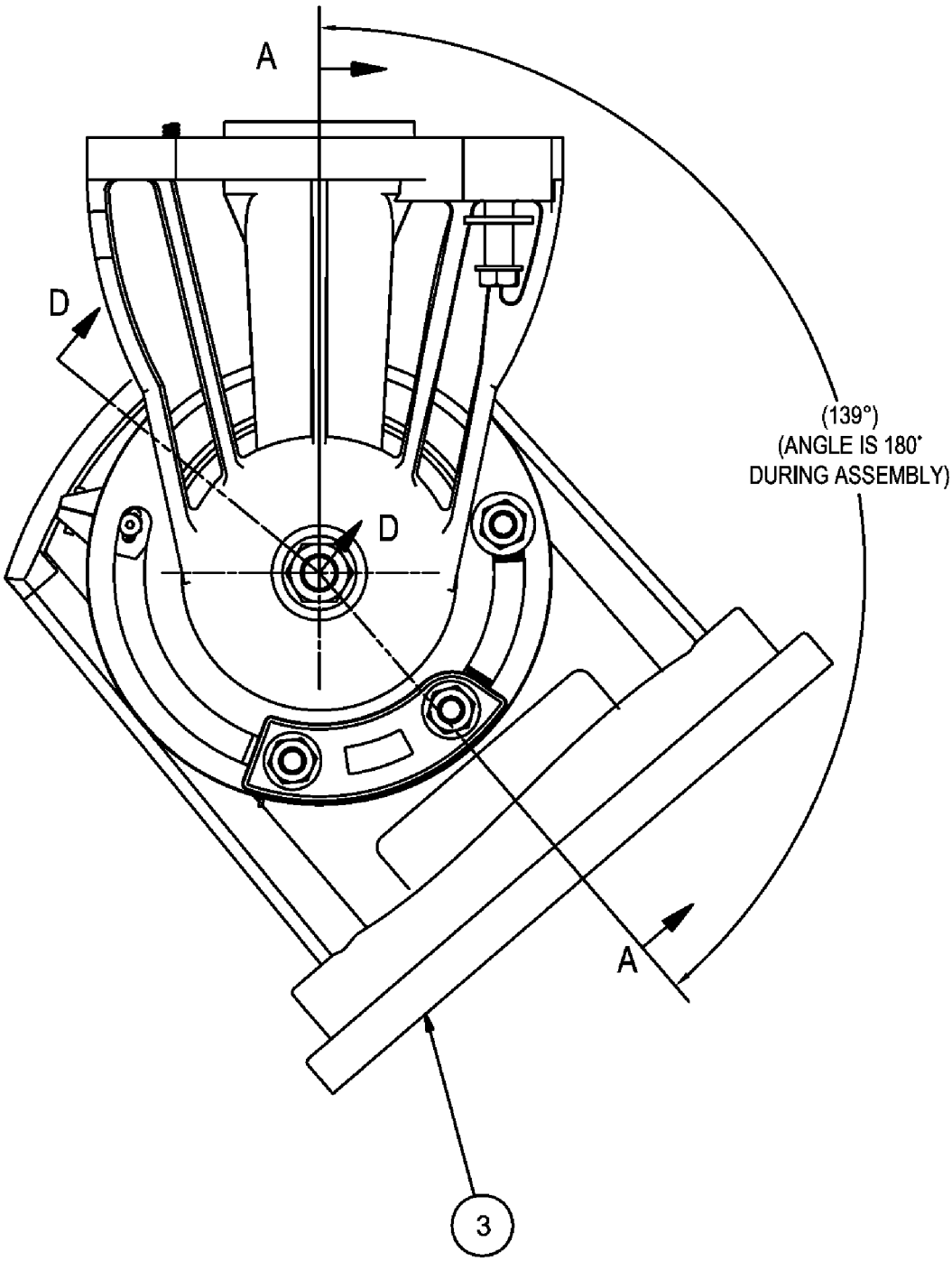
Fig. 3J3

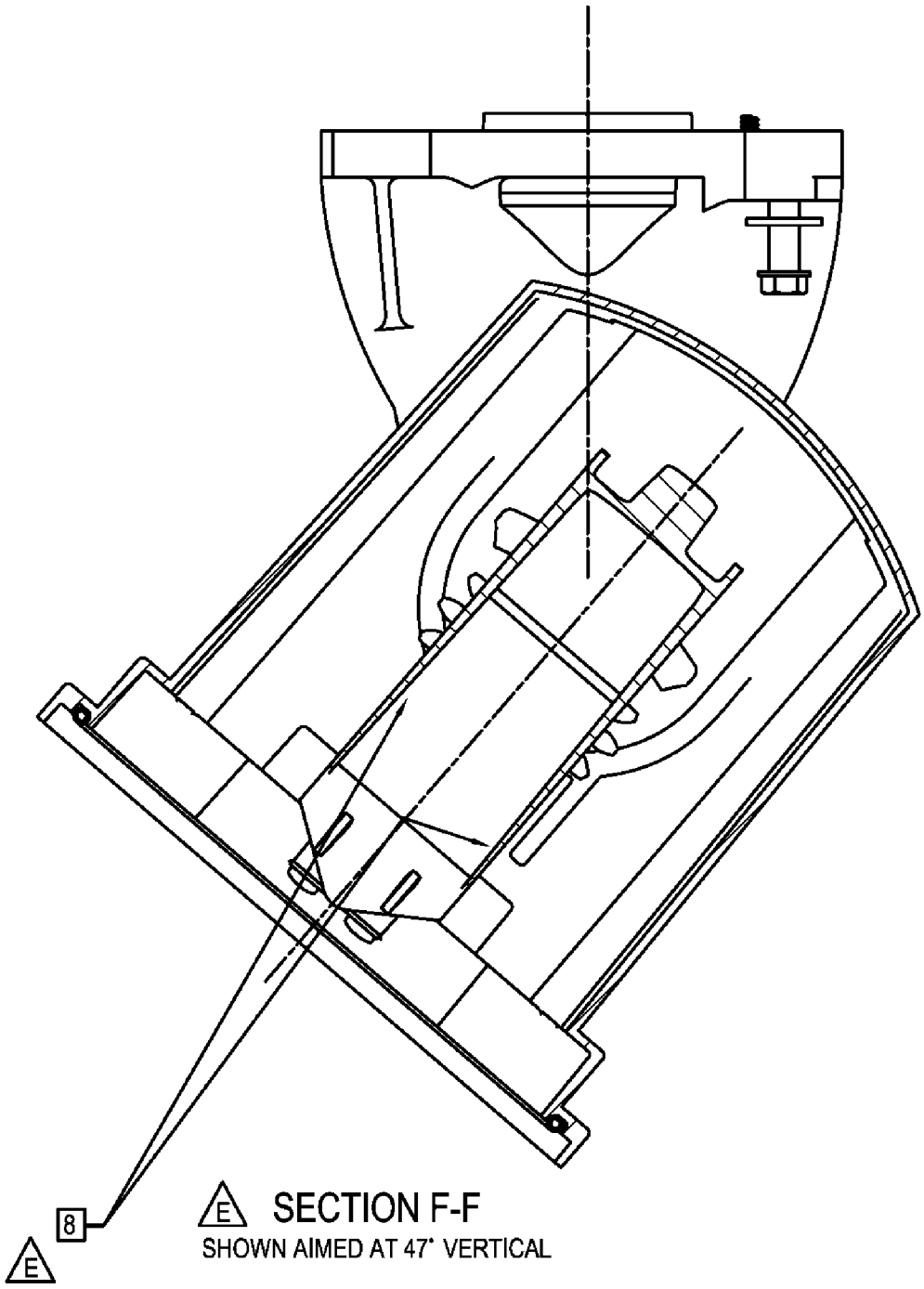
Fig. 3J4

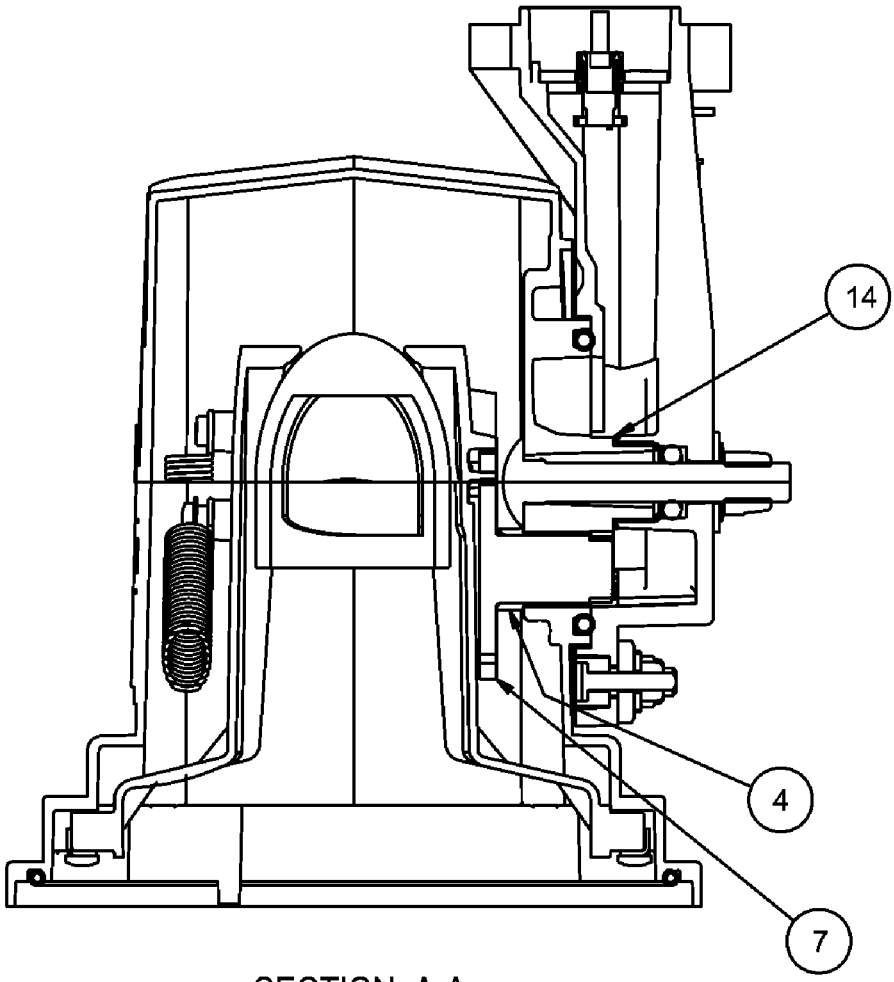
SECTION A-A
*Fig. 3J5*
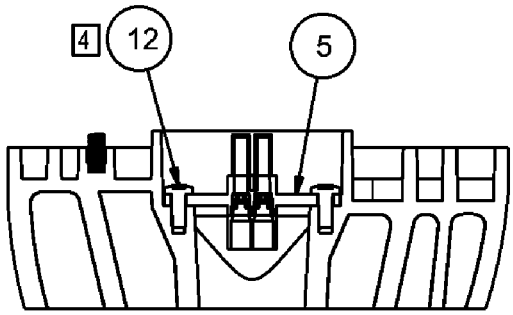
SECTION C-C
*Fig. 3J6*

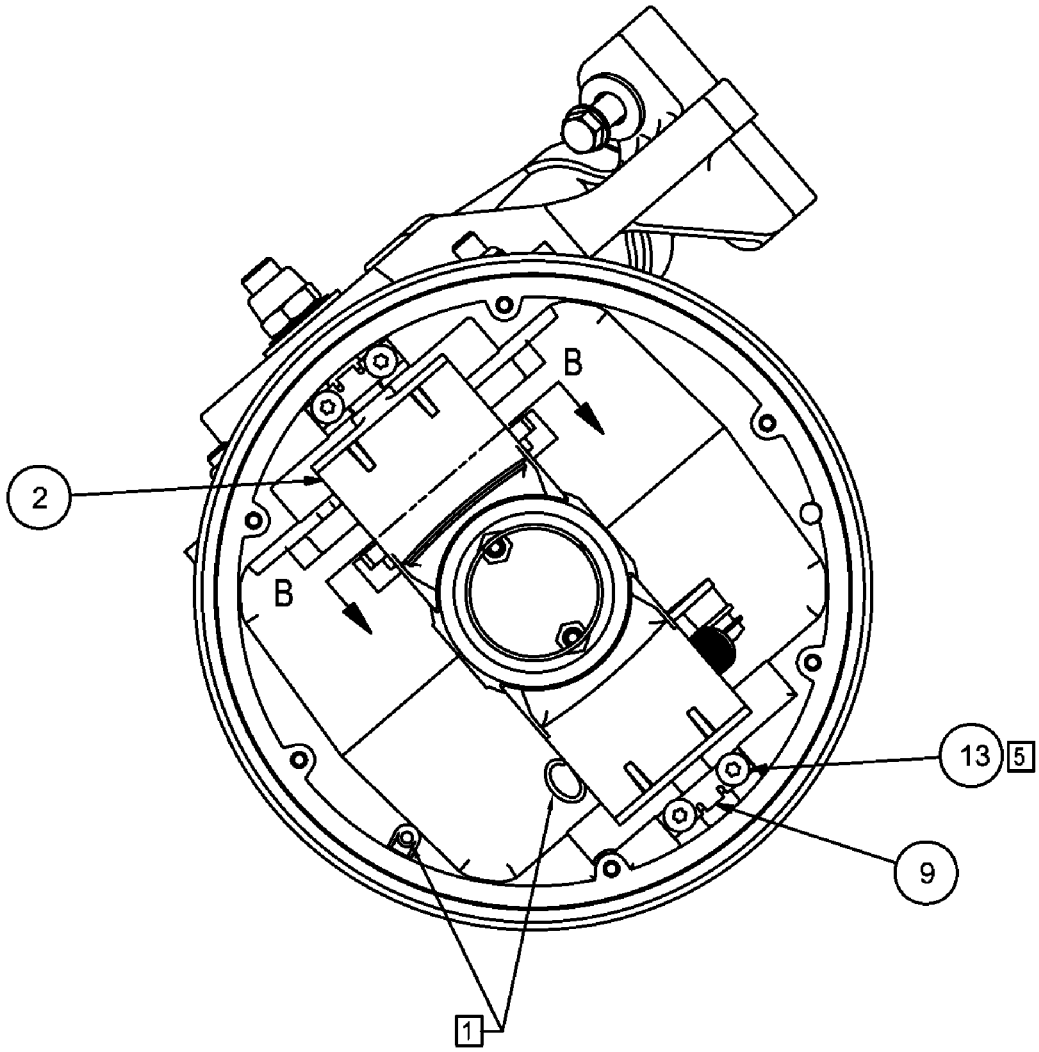
Fig. 3J7
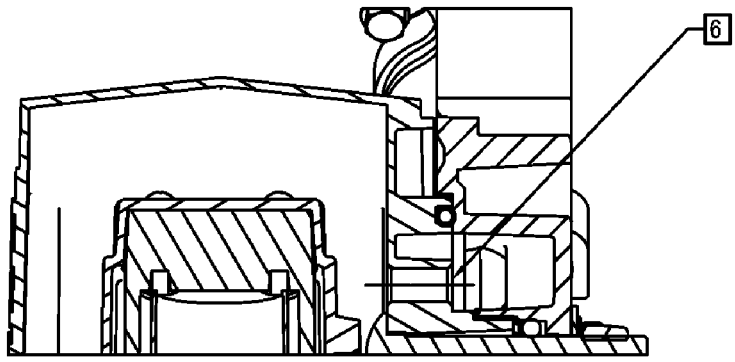
SECTION D-D
Fig. 3J8

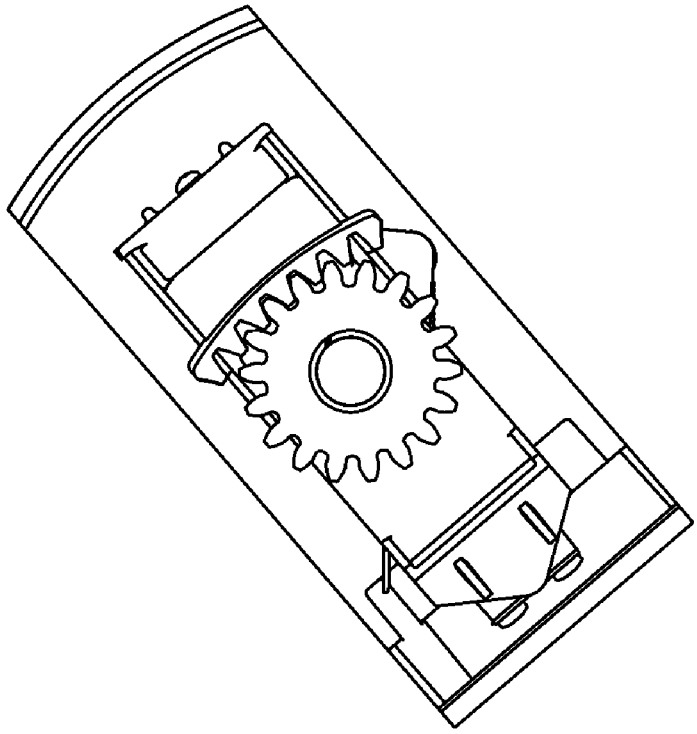
SECTION B-B
*Fig. 3J9*
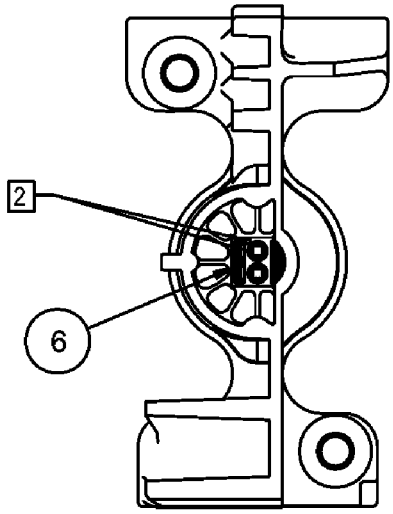
SECTION E-E
*Fig. 3J10*

Figure 1D:
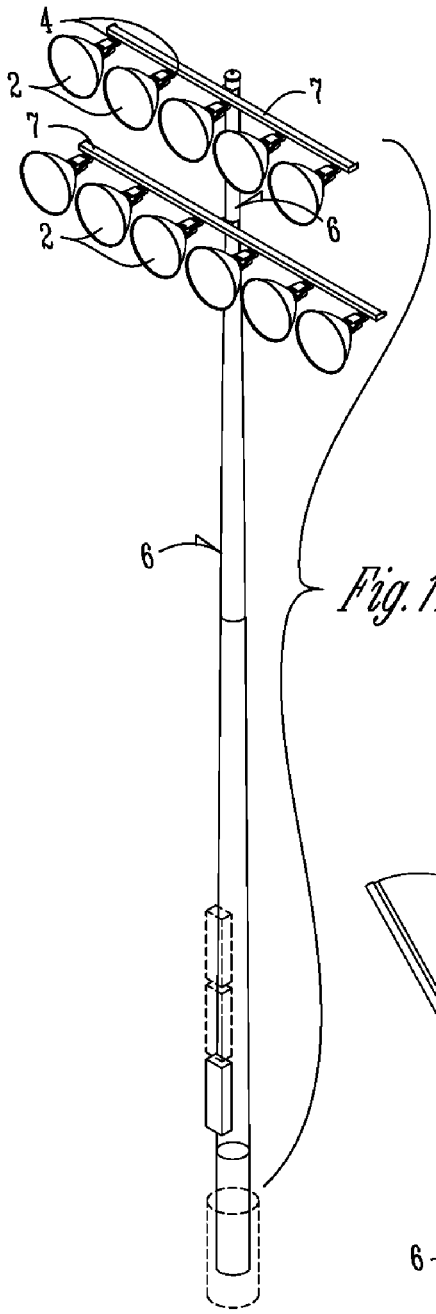
Figure 1G:
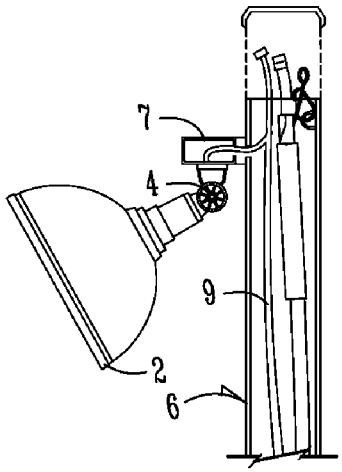

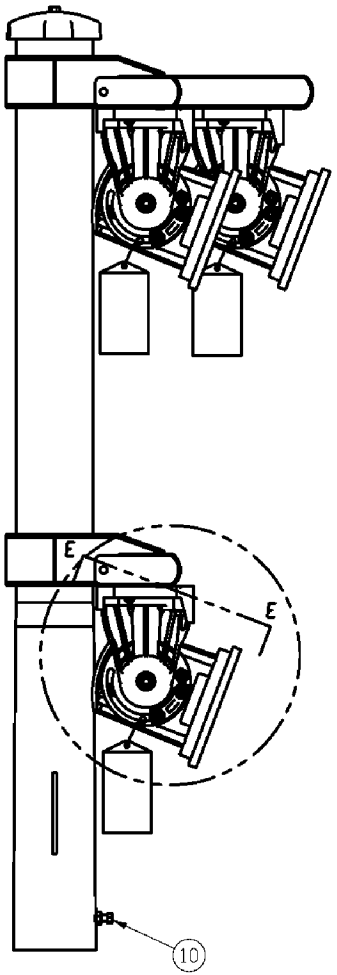
Fig. 6D1B
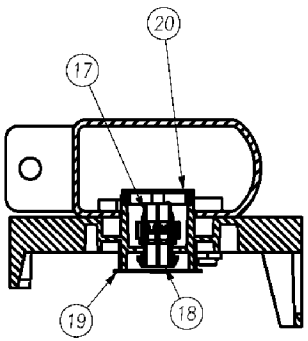
Fig. 6D1C
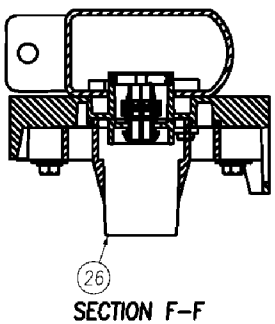
Fig. 6D1D
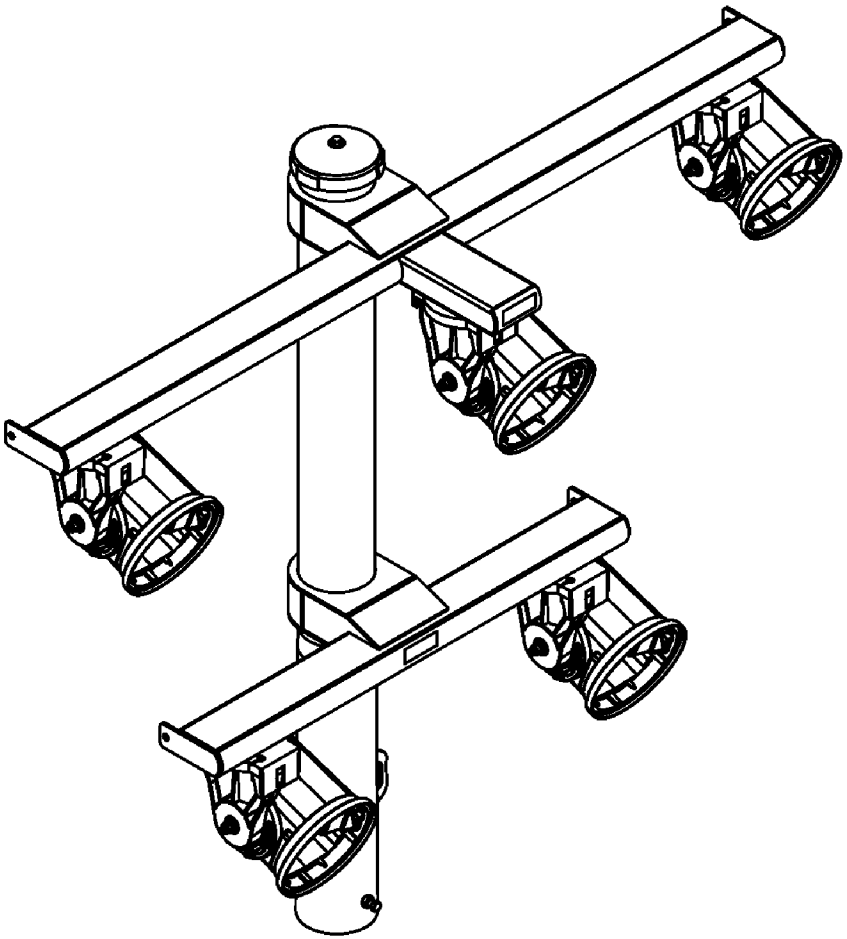
Fig. 6D1A

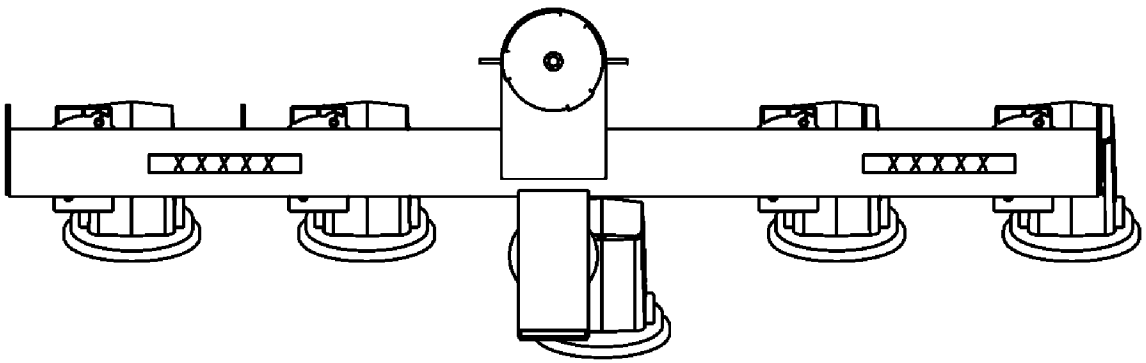
Fig. 6D2B
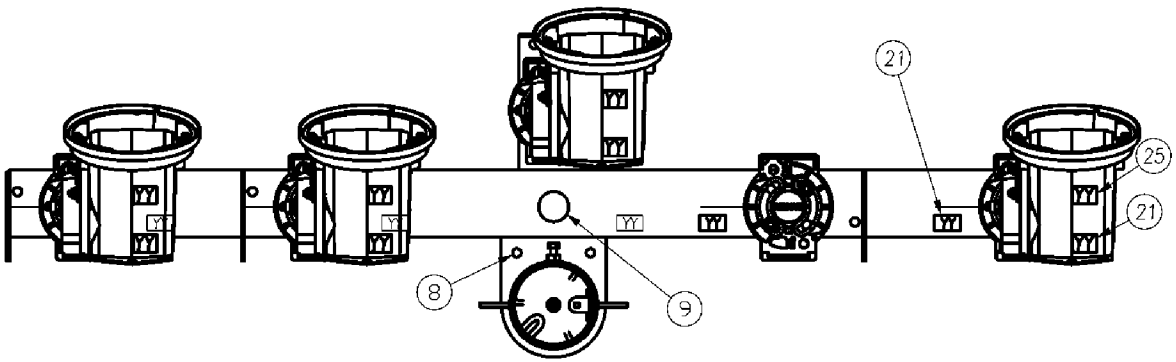
Fig. 6D2A

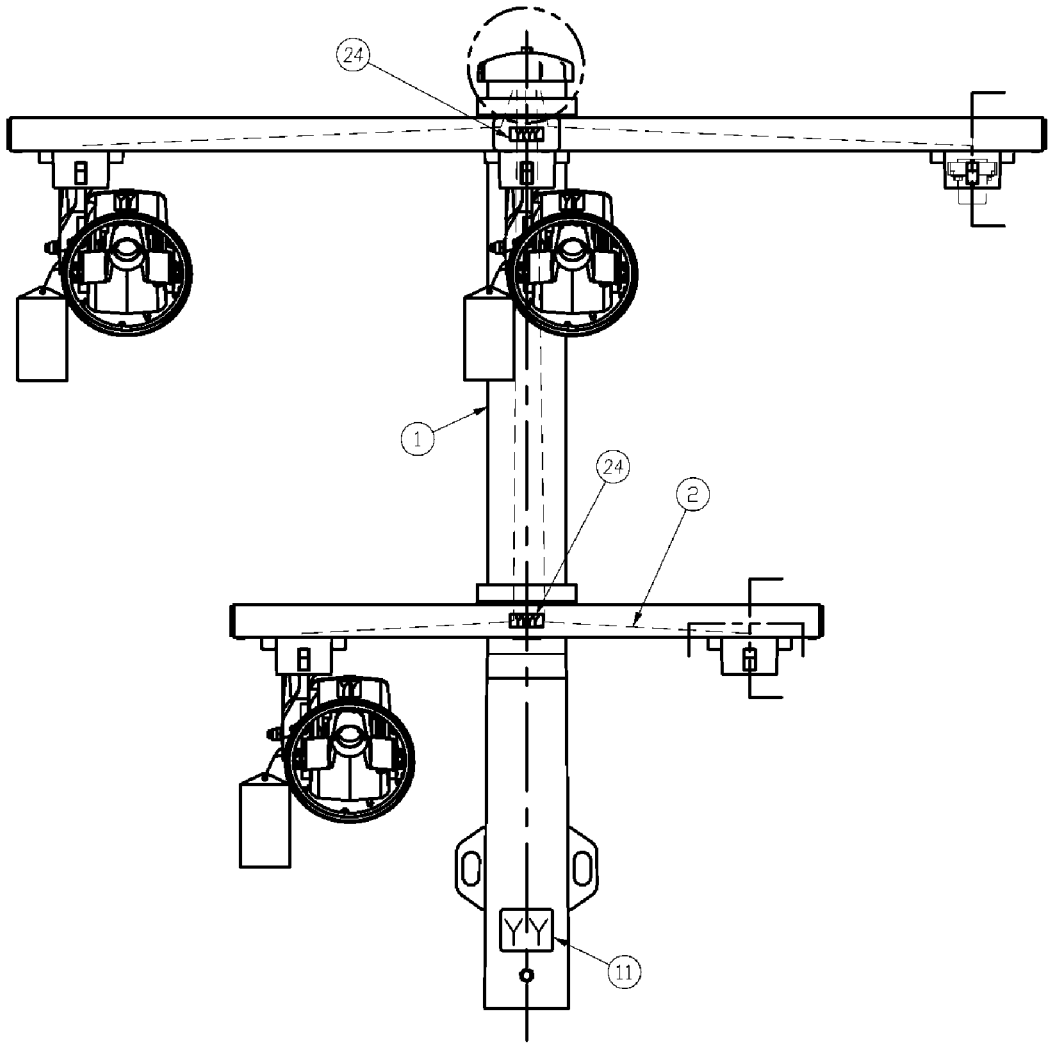
Fig. 6D3A
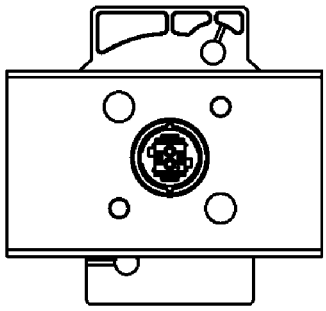
SECTION D–D
Fig. 6D3B
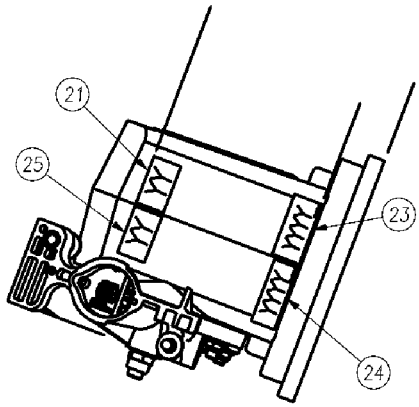
VIEW E–E
Fig. 6D3C

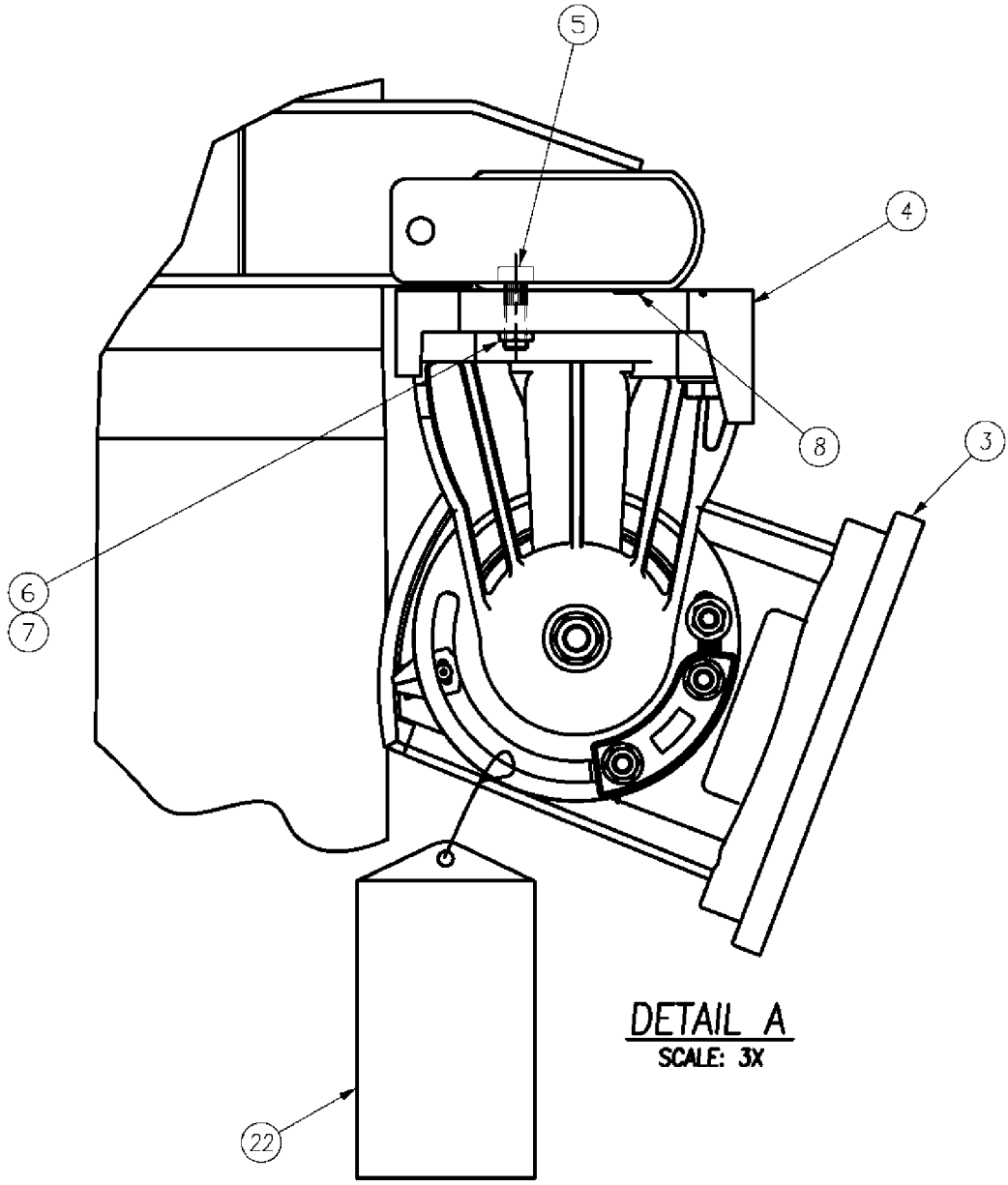
Fig. 6D4

Figure 5A:
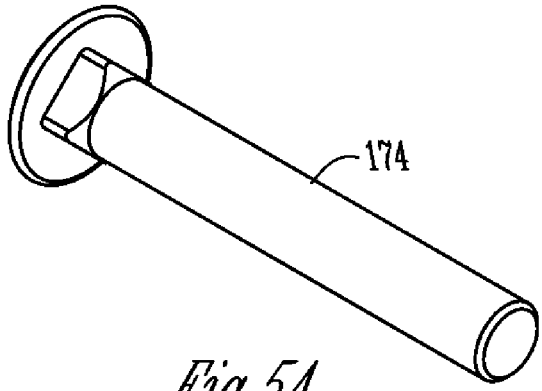
Figure 5B:
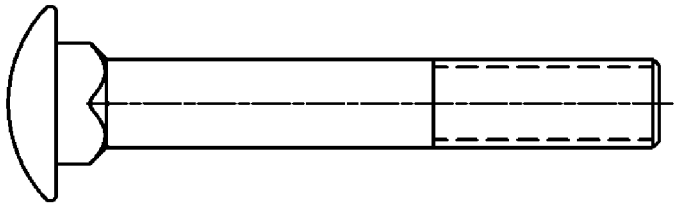

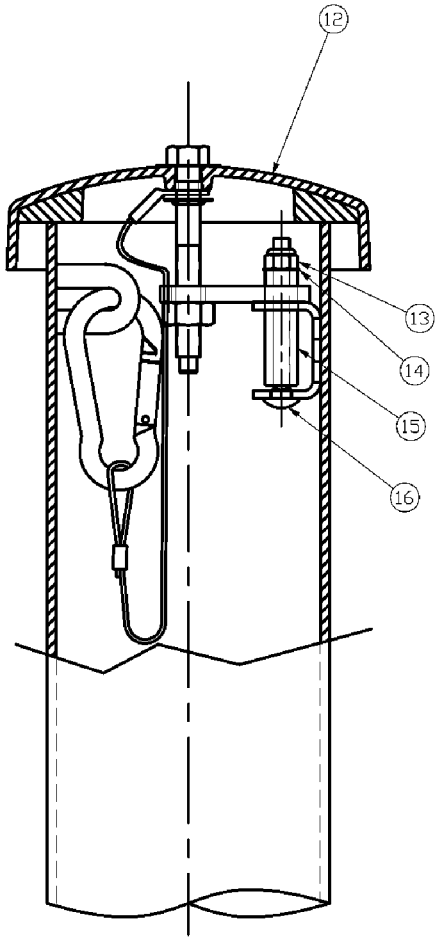
POLE ø < OR = 6.00"
DETAIL B
Fig. 6D5A
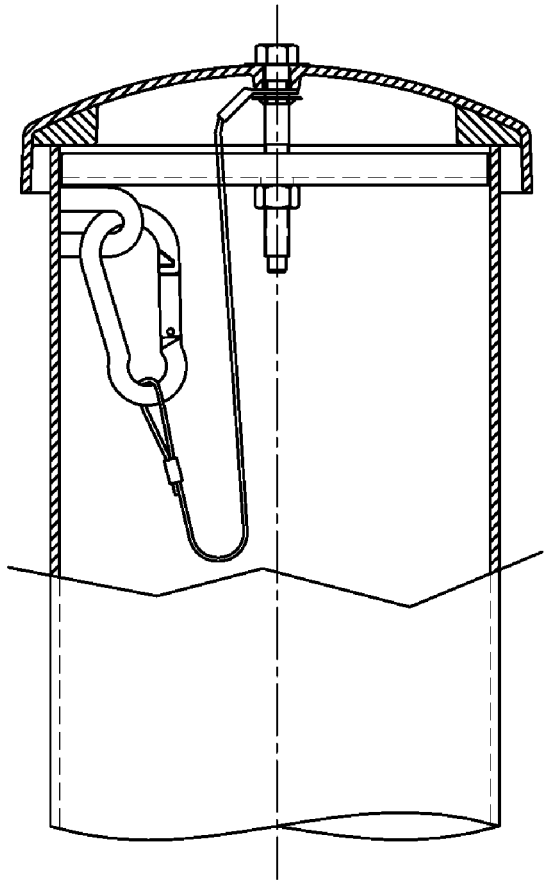
POLE ø > 6.00"
Fig. 6D5B

Fig. 6E1

SECTION A-A

Fig. 6E2

SECTION B-B

APPARATUS AND METHOD FOR COMPENSATING FOR CROSS-ARM WARPAGE WHEN PRE-AIMING LIGHTING FIXTURES AT FACTORY

CROSS-REFERENCE TO RELATED APPLICATIONS

This application claims priority under 35 U.S.C. § 119 of a provisional application U.S. Ser. No. 60/644,537 filed Jan. 18, 2005, which application is hereby incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light. One primary example is illumination of a sports field.

B. Problems in the Art

Illumination of sports fields is generally called sports lighting. FIGS. 1A-1G illustrate one such sports lighting configuration. Football field 5 of FIG. 1A is illuminated by a set of arrays 1 of light fixtures 2 elevated on poles 6 (see FIG. 1A). As is well known in the art, there are known methods to design the number, type, and position of poles 6 and fixtures 2 to provide a desired or required amount and uniformity of light for the field. There are usually pre-designed lighting quantity and uniformity specifications to follow.

The most conventional form of sports lighting fixture 2 is a several feet in diameter bowl-shaped aluminum reflector with a transparent glass lens 3 suspended from a cross arm 7 fixed to a pole 6 by an adjustable knuckle 4 (see FIG. 1B). Each light fixture 2 has some adjustability both around vertical and horizontal axes. Each fixture 2 can therefore be uniquely aimed relative to the target area or field 5 by adjustment of knuckle 4 relative cross arm 7.

It is advantageous and efficient to use the cross-arms as reference points when mounting and aiming the fixtures. If the cross-arm can be assumed to be in a known orientation relative the target area once installed on a pole, the aiming of the fixtures can be a relatively simple process. A pre-determined angular orientation for each fixture relative to its cross-arm can be given to the installer. Sometimes gauges are integrated into the mounting knuckle and the installer simply sets the knuckle to the indicated aiming angle for that fixture. Sometimes the knuckle can even be factory configured to have one angular orientation to eliminate installer error.

While the above methods can save substantial time and labor over individual on-site fixture aiming, the assumption that the cross-arms will end up in the assumed orientation when installed on the poles can be erroneous. For example, this assumes the cross arm is orthogonal to the axis of the pole all along its length. Sometimes, during manufacturing, the surface to which the fixtures are mounted may be warped or other than in a common plane. The cross-arm can be slightly twisted around its longitudinal axis. If the surface is not in a common plane and orthogonal to the axis of the pole, even if the installer mounts the fixtures in their pre-determined angular orientation to the ground, they will not be correctly aimed. Because the fixtures are many times hundreds of feet from their intended target on the target area or field, a relatively small warpage (e.g. a few degrees from the assumed plane or less) could result in a substantial shift of the center of the beam on the field. This can result in non-uniformity in lighting at the field. It sometimes can result in light spilling outside the field.

II. SUMMARY OF THE INVENTION

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) more effectively utilize the light produced at each fixture relative to a target area;

b) can reduce glare and spill light relative a target space or area.

B. Exemplary Aspects of the Invention

An aspect of the invention is a method of compensating for warpage or other than perfect shape of a cross-arm for suspending lighting fixtures, where the lighting fixtures are mounted to the cross-arm according to pre-determined aiming angles based on the assumption the cross-arm is perfectly orthogonal to the light pole when installed.

These and other objects, features, advantages and aspects of the present invention will become more apparent with reference to the accompanying specification and claims.

III. BRIEF DESCRIPTION OF THE DRAWINGS

A. General Sports Lighting Systems

FIG. 1A and its sub-parts B-G illustrate generally a sports lighting system, and conventional components for a sports lighting system.

B. General Parts of Fixture 10

FIG. 2 is a diagrammatic, partial exploded view of a light fixture 10 according to an exemplary embodiment of the present invention.

C. Lamp Cone 40

FIGS. 3A-J are various plan, sectional, and isolated views of a lamp cone according to an aspect of the invention.

D. Knuckle Plate 60

FIGS. 4A-D and 4F-I are a perspective view, various plan views, sections, and isolated views of a knuckle plate according to an aspect of the invention.

Figure 5C:
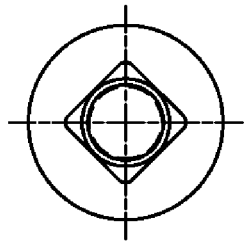
Figure 6A:
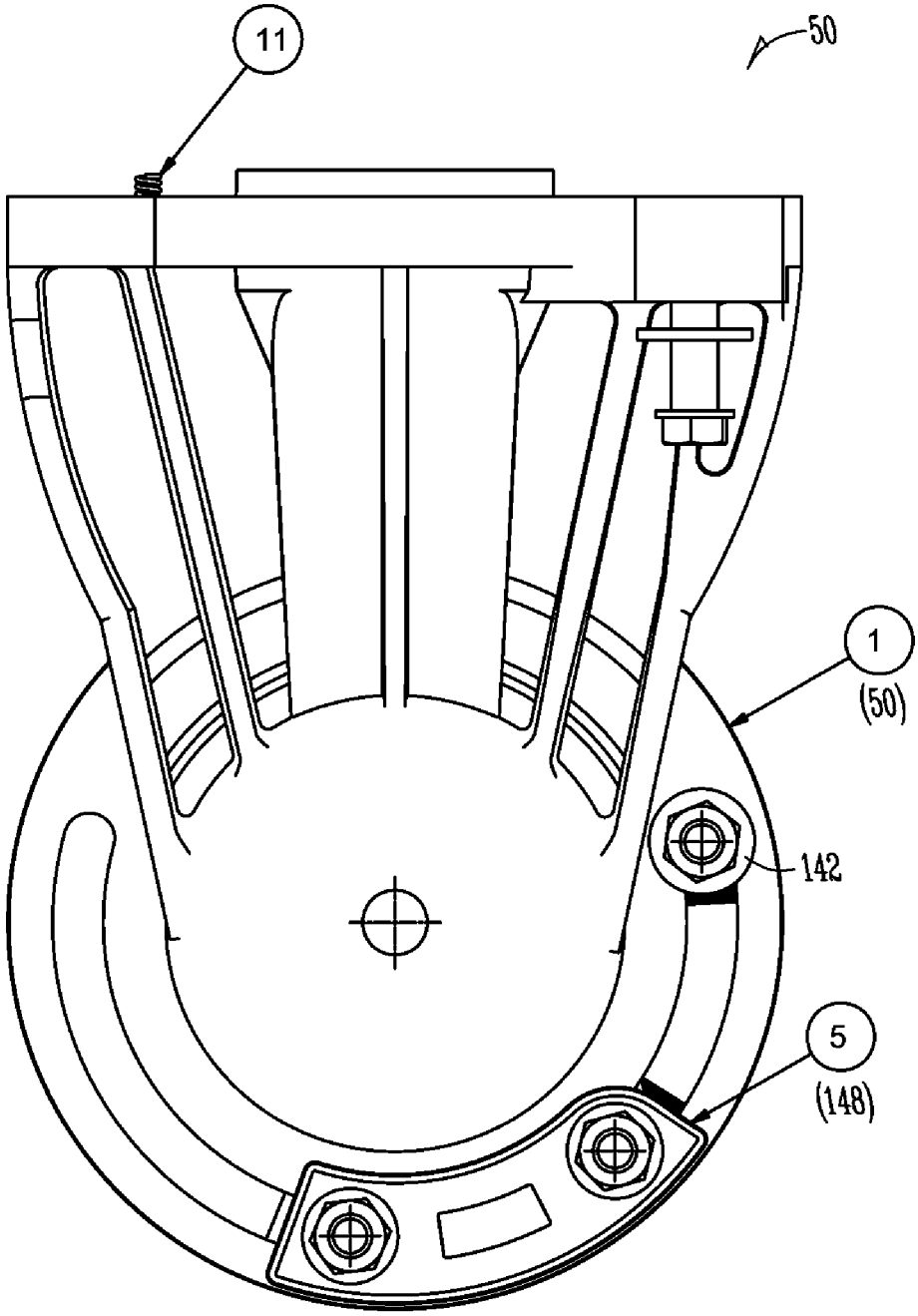
Figure 6B:
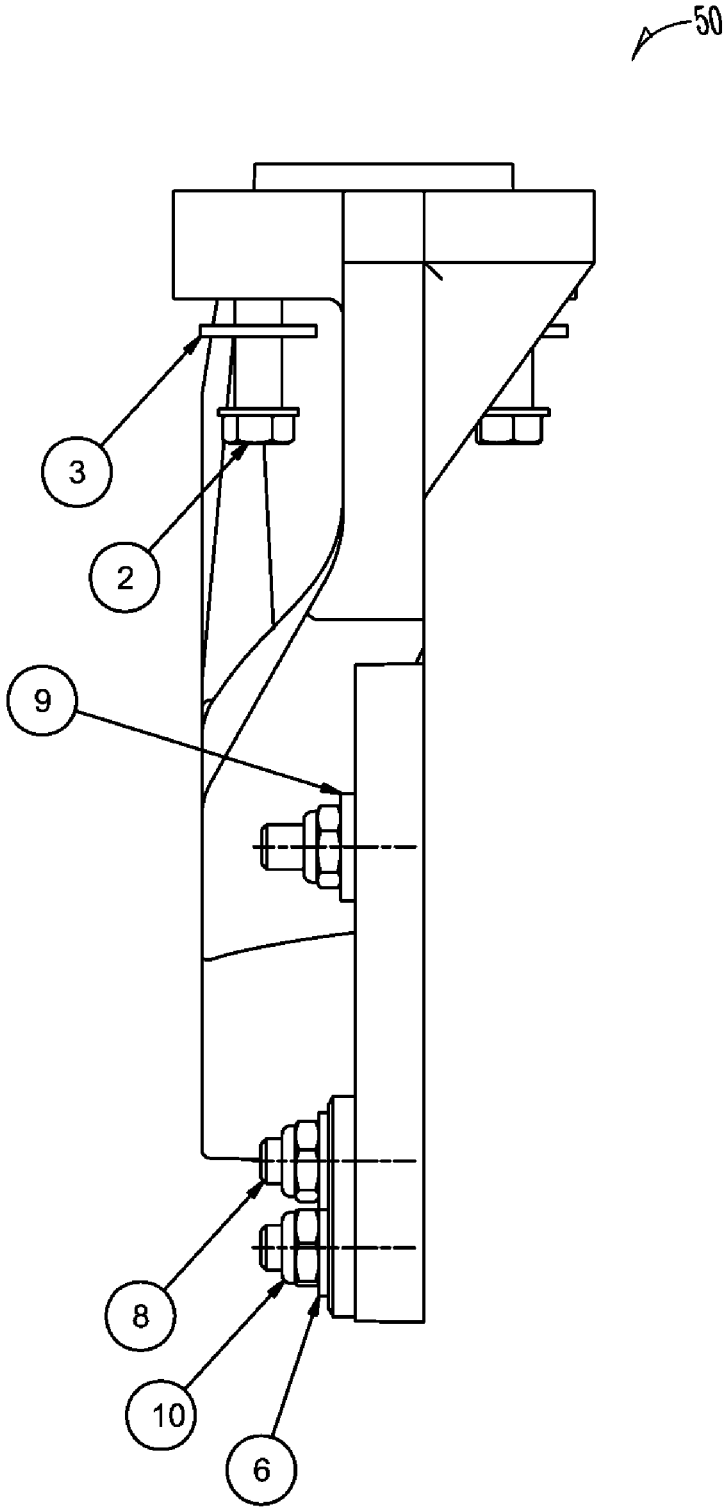

FIGS. 5A-C are various views of a bolt for holding a knuckle of FIG. 6A to the lamp cone of FIG. 3A.

E. Knuckle 50

Figure 4A:
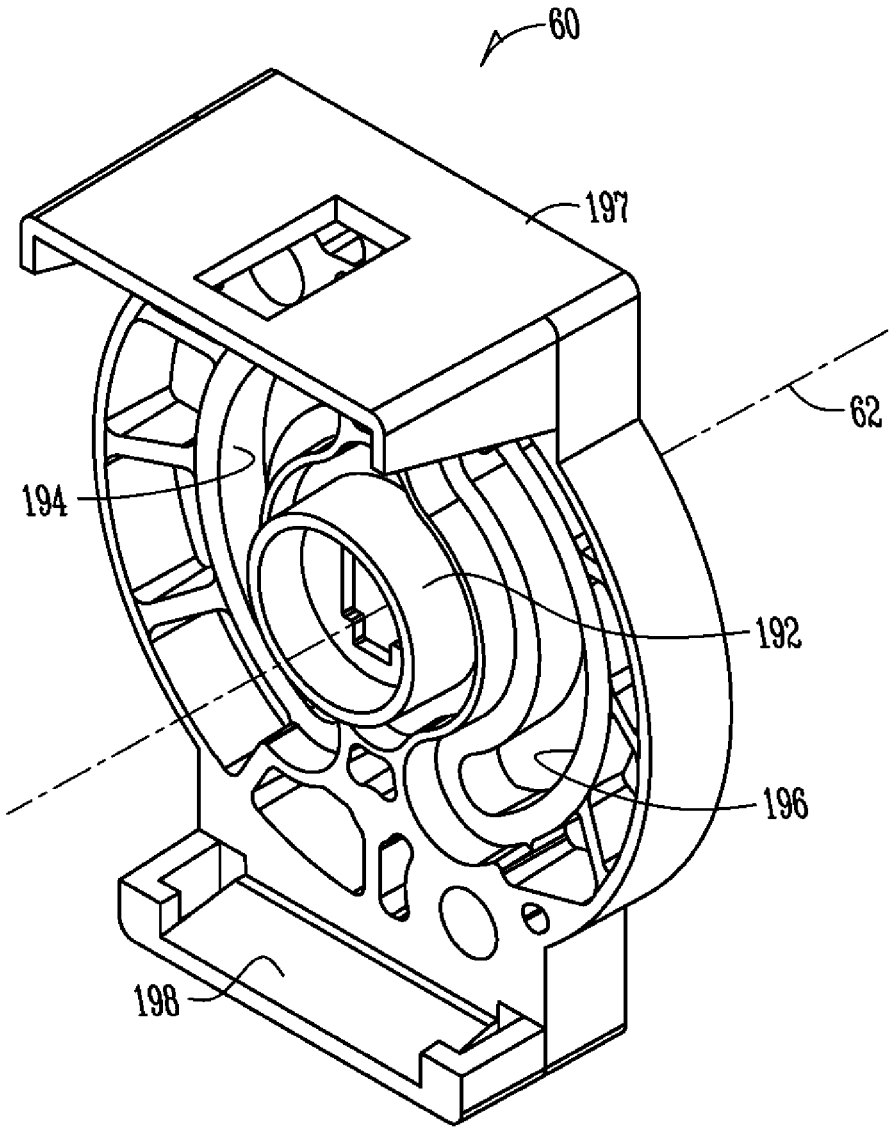
Figure 4B:
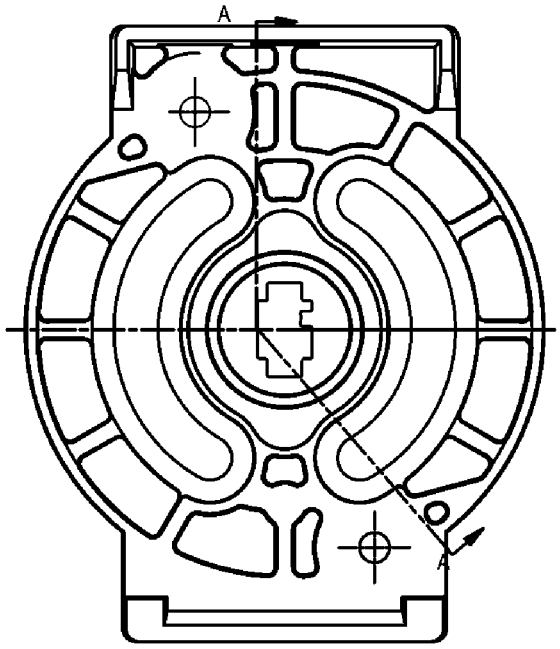
Figure 4C:
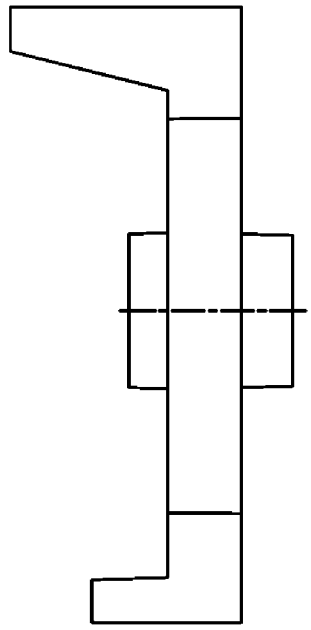
Figure 4D:
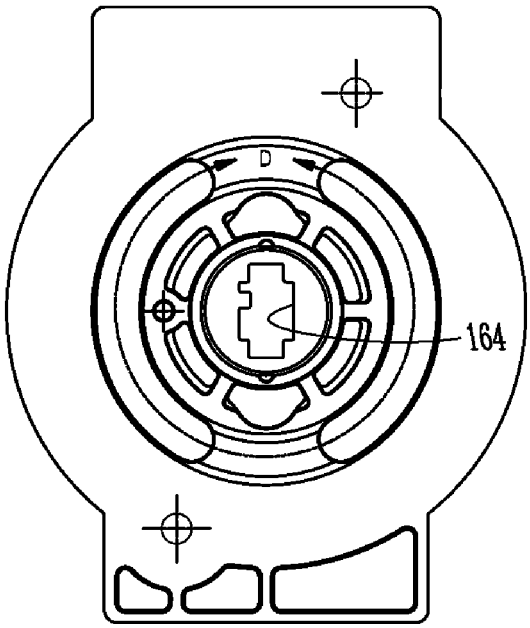
Figure 4G:
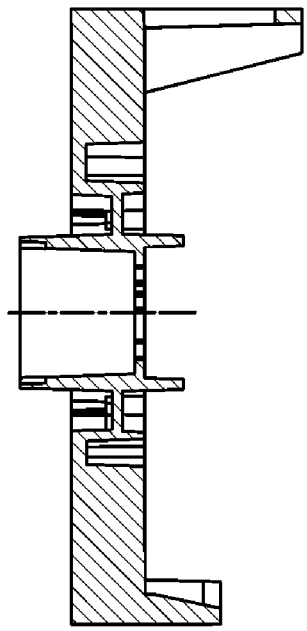
Figure 4F:
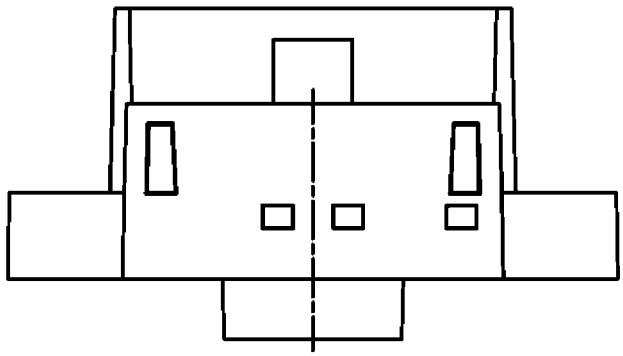
Figure 4H:
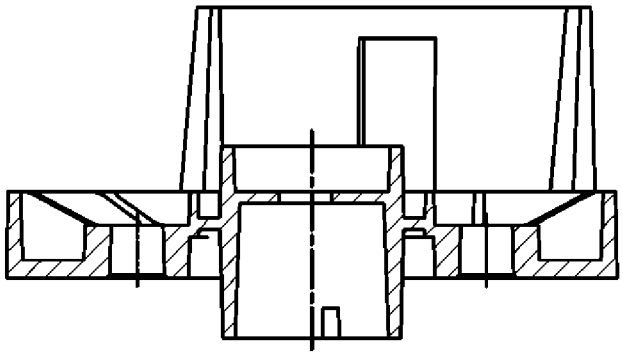
Figure 4I:
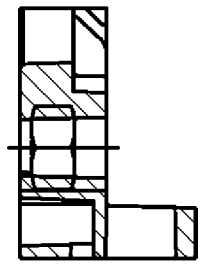

FIGS. 6A-K are various views of a knuckle connectable between the knuckle plate of FIG. 4A and the lamp cone of FIG. 3A.

Figure 7A:
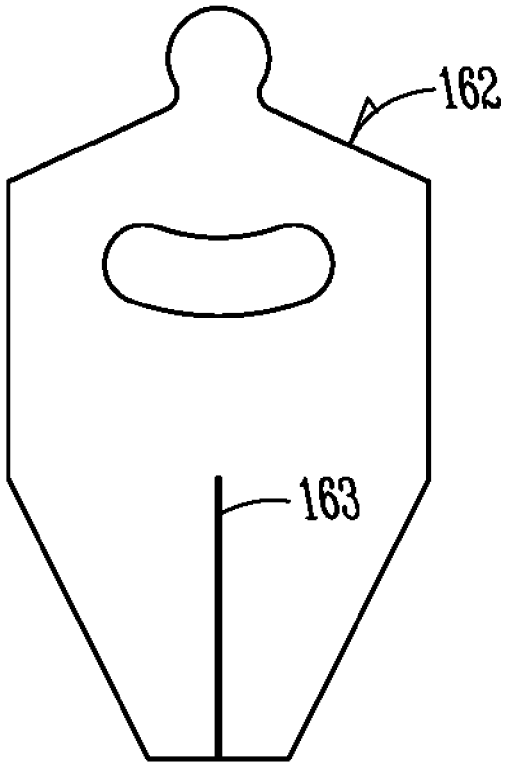
Figure 7B:
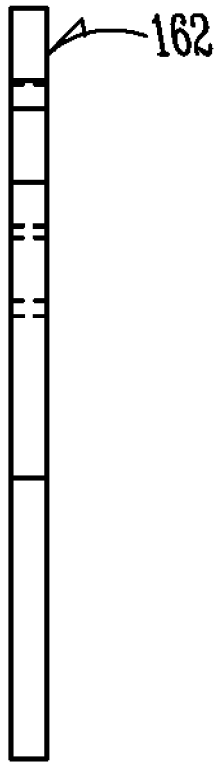
Figure 8A:
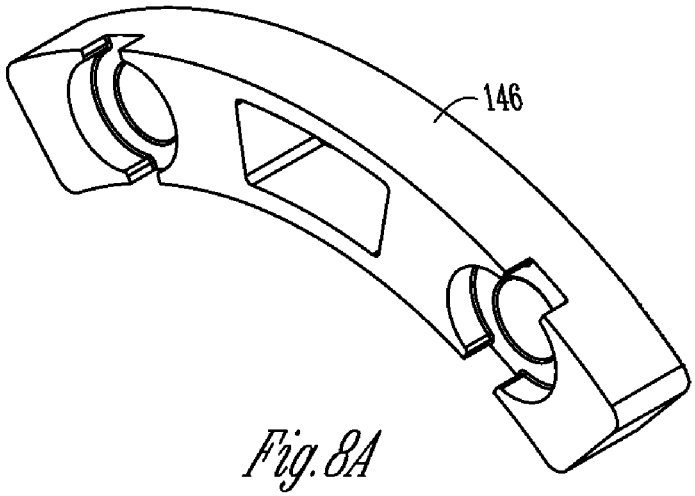
Figure 8B:
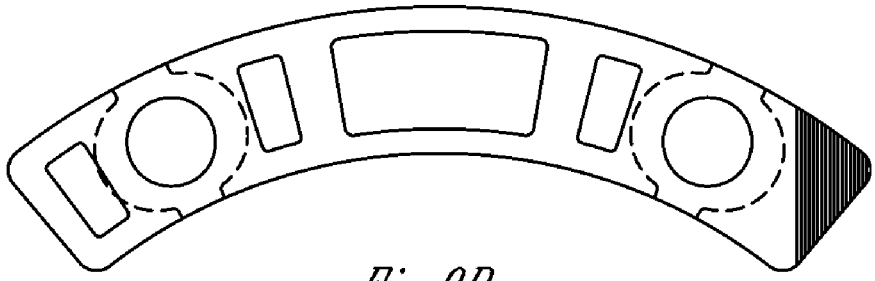
Figure 8C:
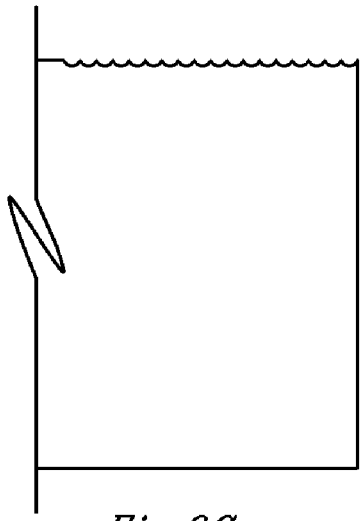
Figure 9A:
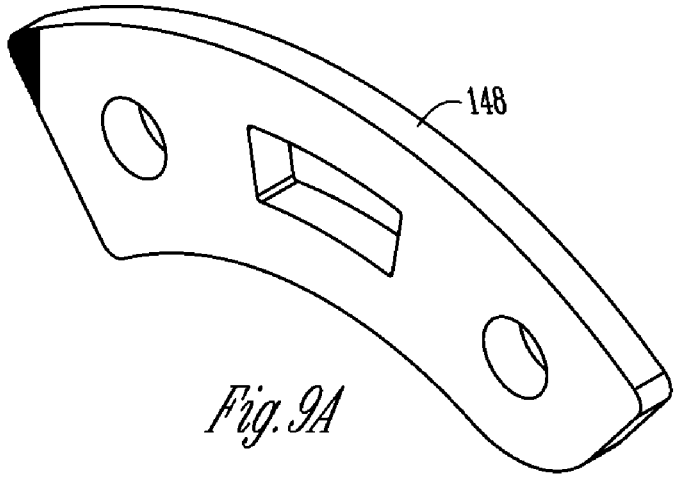
Figure 9B:
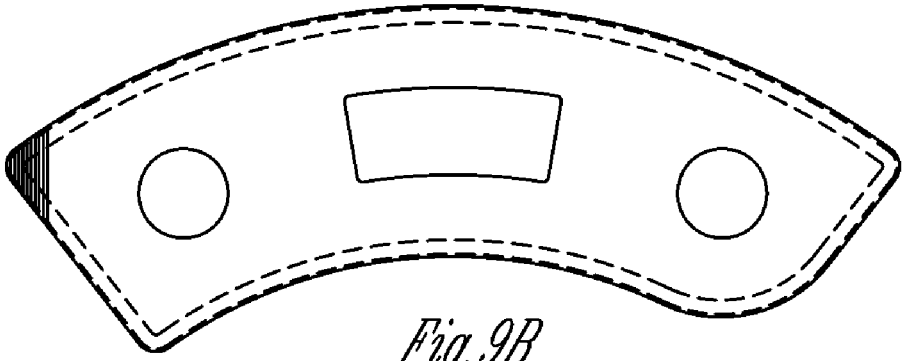
Figure 9C:
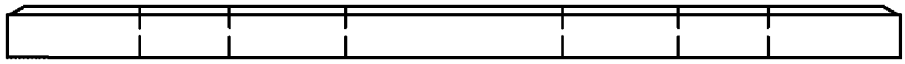
Figure 9D:
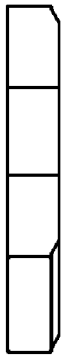
Figure 9E:
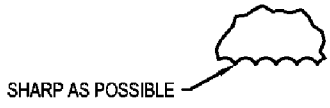
Figure 9F:
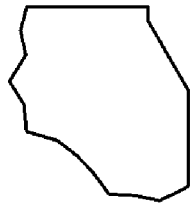
Figure 10A:
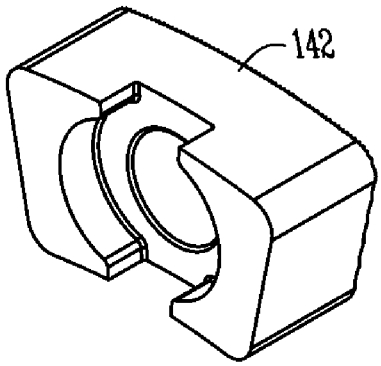
Figure 10B:
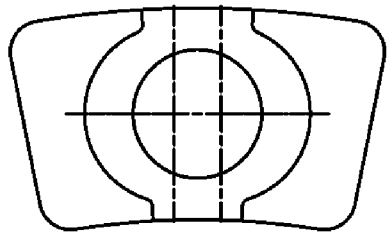
Figure 10C:
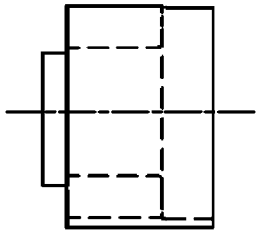
Figure 10D:
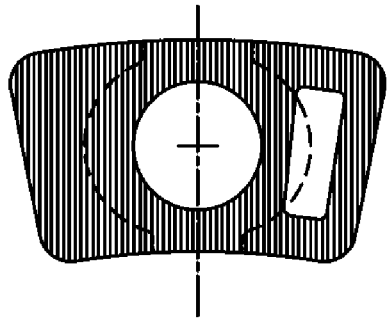
Figure 10E:
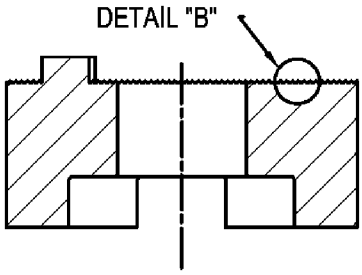
Figure 10F:
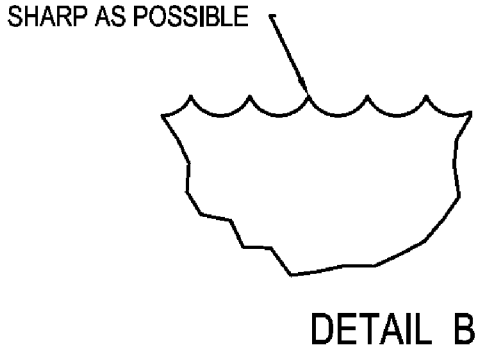

FIGS. 7A-B are front and side views of a zero alignment gauge useable with the knuckle of FIG. 6A and the lamp cone of FIG. 3A.

FIGS. 8A-C, 9A-F, and 10A-F, are various views, respectively, of an inside strap, outside strap, and inside stop strap useable with lamp cone of FIG. 3A to provide for accurate repositioning of the lamp cone if moved from factory alignment, for example, for maintenance purposes.

IV. DETAILED DESCRIPTION OF EXEMPLARY EMBODIMENTS

A. Overview

An embodiment of a light fixture will be described in the context of sports lighting, sports lighting fixtures, and sports lighting systems for the illumination of athletic fields such as shown in FIGS. 1A and 1C. The lighting must light the field and a volume of space above the field (collectively sometimes called the target area or target space), according to predetermined lighting level and uniformity specifications. The embodiment relates to fixtures that utilize high intensity discharge (HID) lamps, presently normally 1,000 watts or higher, of the metal halide type. Such installations generally have several arrays of fixtures usually elevated on two or more relatively tall poles (35 feet to 100 or more feet).

In this context, the athletic field is therefore the target area or space. There could be more than one target area per sports facility. It is to be understood, however, that the present invention has applicability to other applications utilizing these or other HID lamps, and is not limited just to these types of HID lamps or to sports lighting.

B. Exemplary Apparatus

1. Lighting Fixture 10 Generally

FIG. 2 shows the basic components of sports lighting fixture 10 in exploded form. Fixture 10 has some similar general components to state-of-the-art sports lighting fixtures, but introduces some different structural components and concepts. Mounting or knuckle plate 60 (360 Aluminum with polyester powder coat) bolts to the underside of a cross arm 7. It has adjustability around vertical axis 62 (see FIG. 4A). Knuckle 50 (360 Aluminum with polyester powder coat) bolts at one end to the bottom of knuckle plate 60 and extends to a pivot connection to lamp cone 40 along axis 52 at its other end (See FIG. 2A). It should be appreciated that knuckle 50 essentially supports the remainder of fixture 10 and does so with essentially one arm extending from a cross arm down to one side of lamp cone 40. Knuckle 50 is a relatively non-complex structure.

Lamp cone 40 (360 Aluminum with polyester powder coat) pivots around axis 52 relative to knuckle 50. It contains a socket 154 (commercially available or well-known in the art) which is bolted to the flat web 160 between the arms 156 and 158 of yoke 80. Lamp 20 (Musco Corporation Z-Lamp™) has a threaded base that can be screwed in and out of socket 154 (shown screwed into operating position in FIG. 2) to install or remove lamp 20.

2. Lamp Cone 40, Knuckle 50, and Knuckle Plate 60

Lamp cone 40, knuckle 50, and knuckle plate 60 form the adjustable joint between cross arm 7 and reflector frame 32. Lamp cone 40 also supports lamp 20. FIG. 3A and subparts illustrate details about lamp cone 40. Lamp cone 40 is basically enclosed except for front opening 132 to which reflector frame 30 is bolted and sealed with a gasket, and several opening in the side (e.g., for the knuckle bolt and a pinion gear).

Figure 6C:
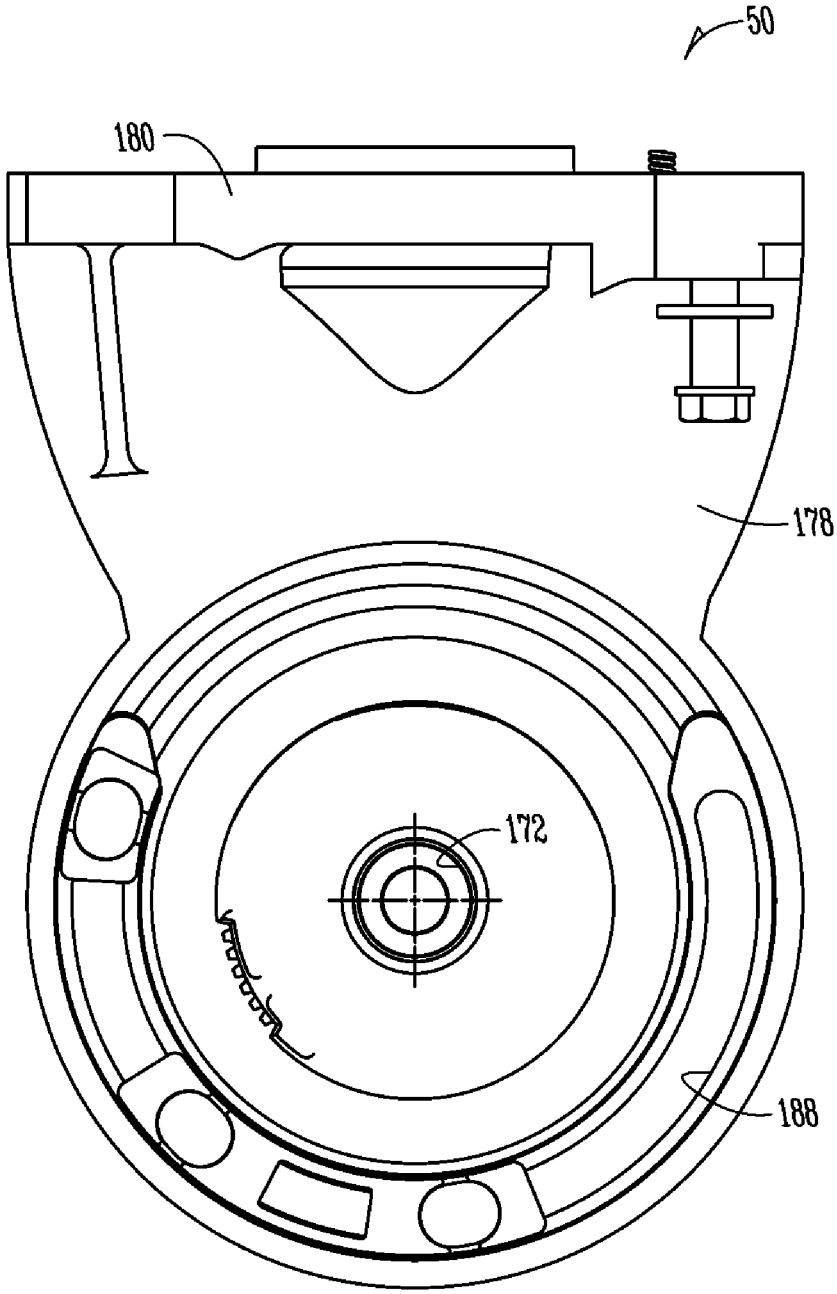
Figure 6F:
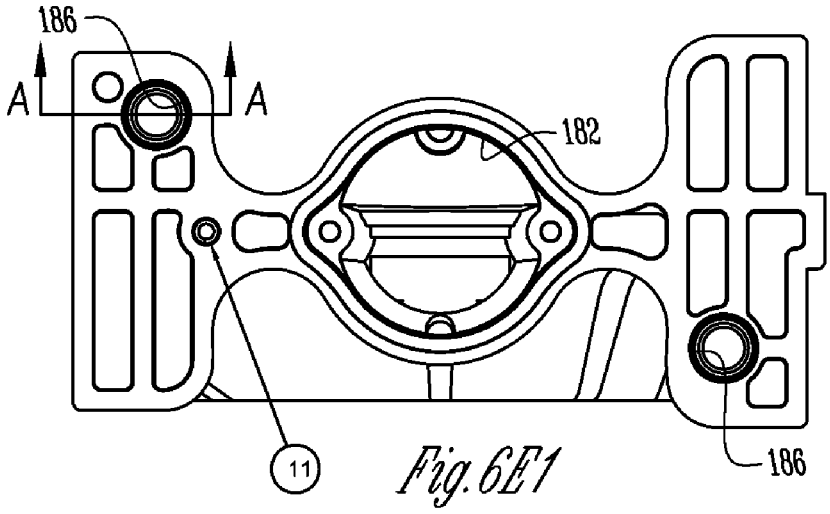
Figure 6F:
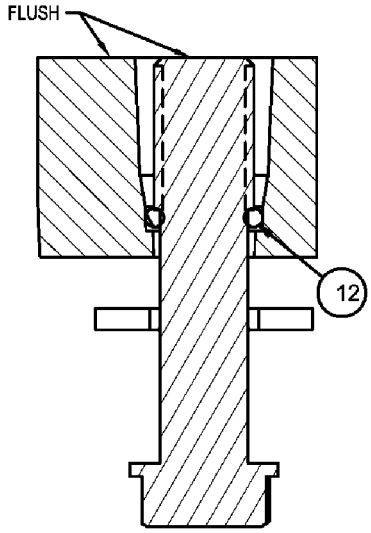
Figure 6F:
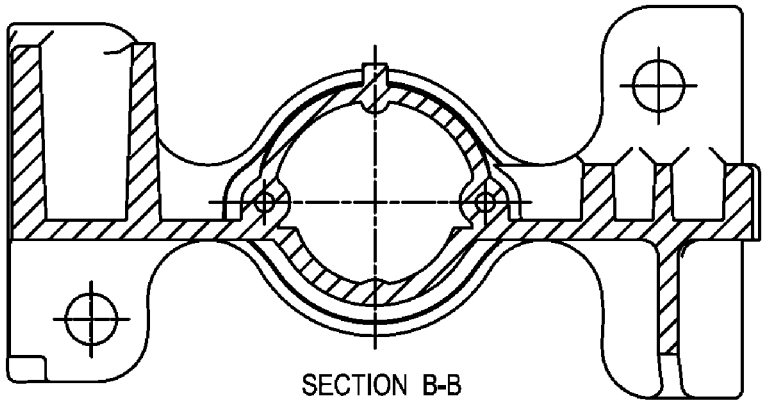
Figure 6G:
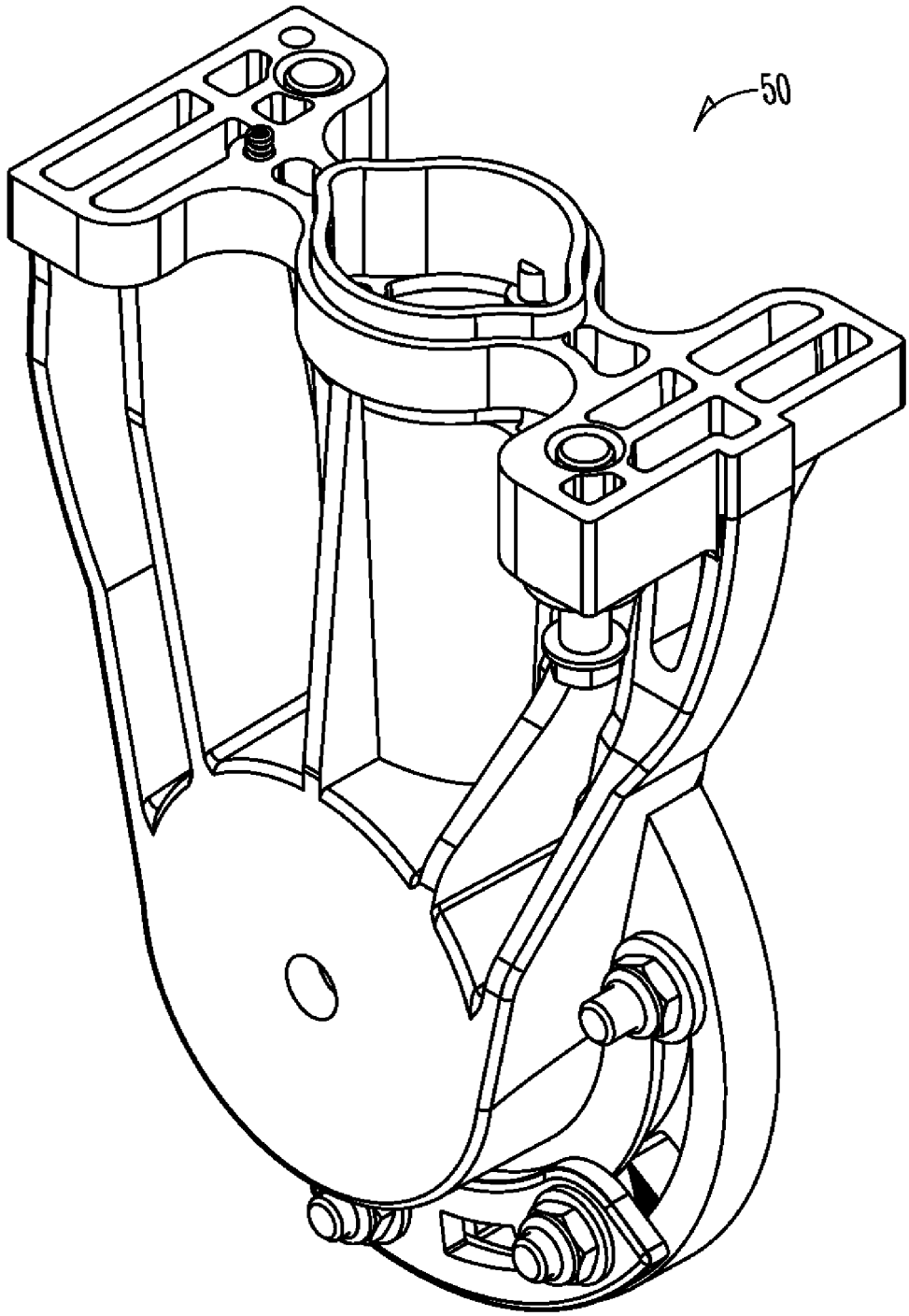
Figure 6H:
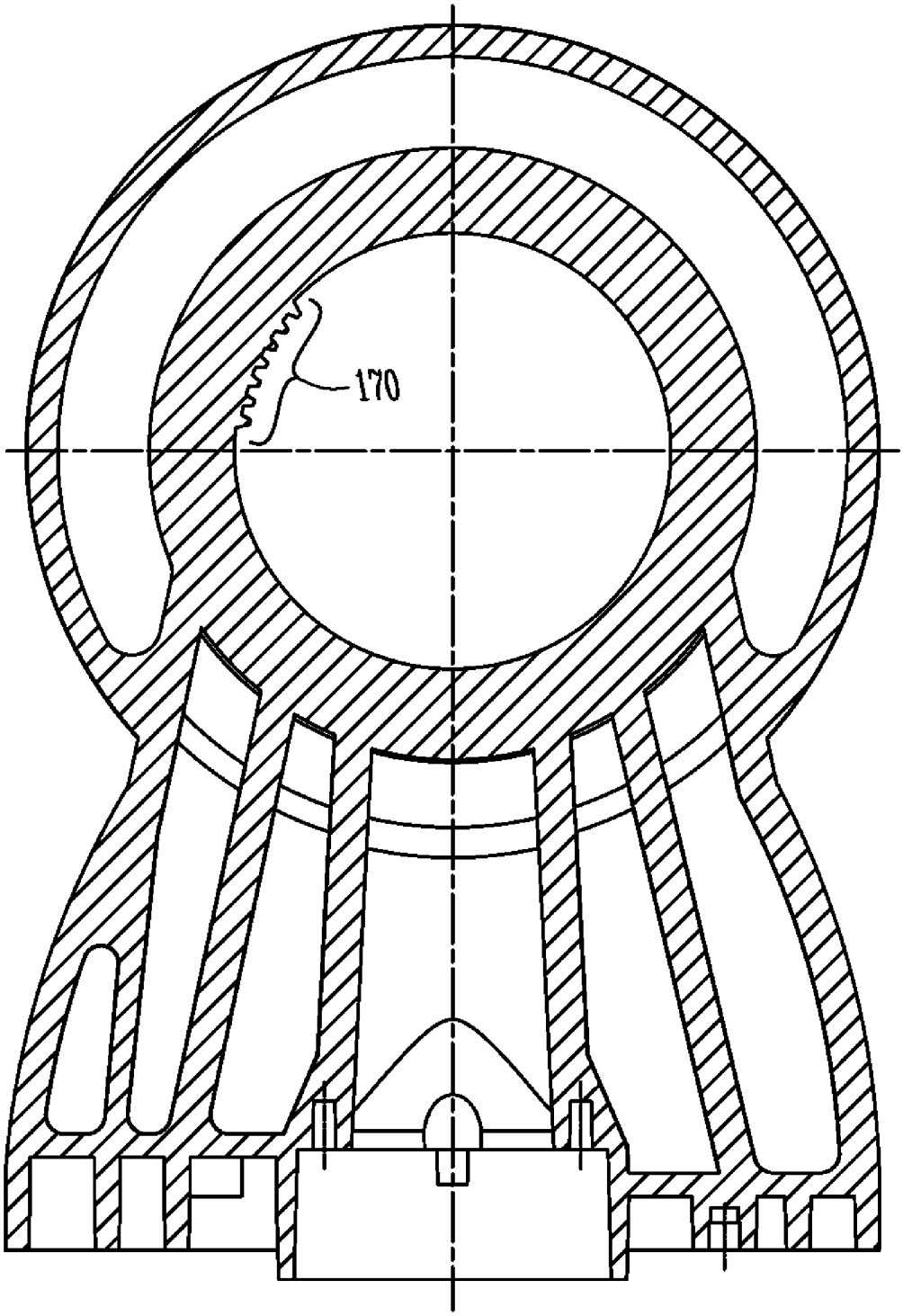
Figure 6I:
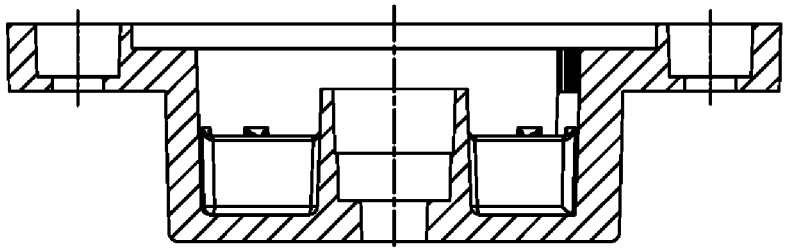
Figure 6J:
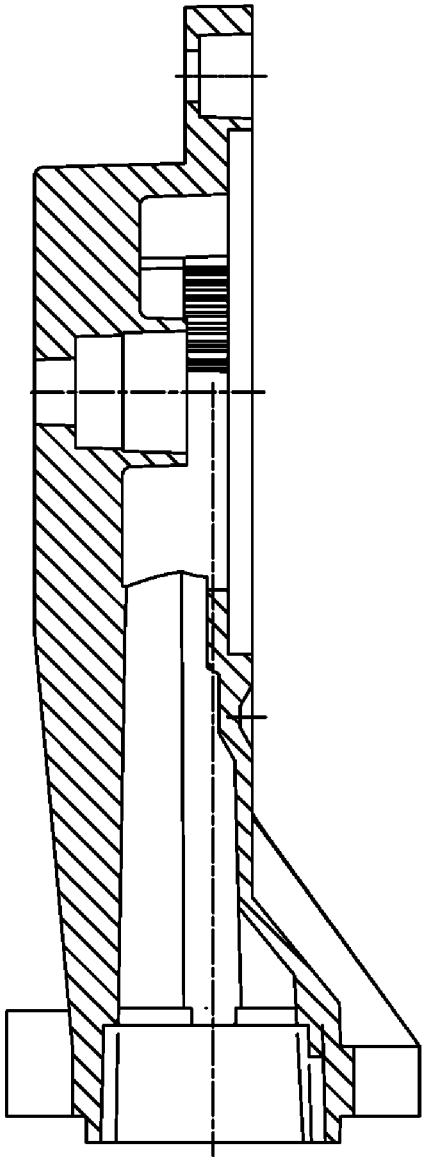
Figure 6K:
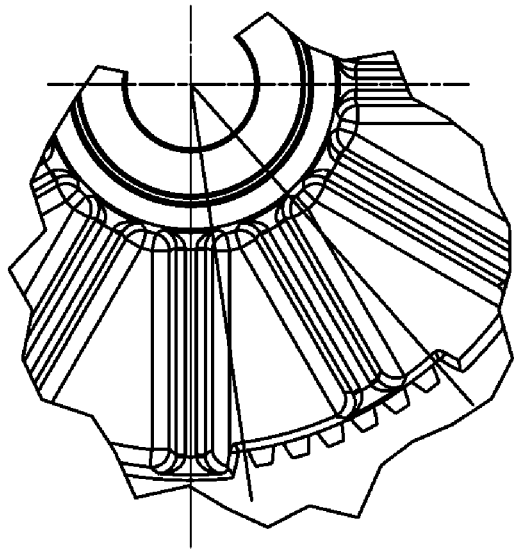

Lamp cone 40 pivotally attaches to knuckle 50 by inserting laterally projecting boss or pivot 136 on the side of lamp cone 40 into a complimentary circular cut-out or receiver 172 in one lateral side of knuckle 50 (see FIG. 6C). Knuckle bolt 174 (see FIG. 5A), with appropriate nut and washers, holds lamp cone 40 from separation from knuckle 50 when assembled together. A gasket 176 fits between lamp cone 40 and knuckle 50 concentrically about pivot receiver 172 and opening 174 and knuckle 50 to deter water, insects, or dirt from entering into knuckle 50. As can be seen in FIGS. 3 and 6, when these parts are assembled, complimentary structure on the interfaces of lamp cone 40 and knuckle 50 act as bearing surfaces and retaining structure to provide for smooth, accurate rotation of lamp cone 40 relative to knuckle 50.

As shown in the drawings, knuckle 50 connects to knuckle plate 60 (see FIG. 4) which in turn is fixedly mounted to cross arm 7. Arm portion 178 of knuckle 50 extends to a mounting end 180. Knuckle plate 60 bolts to the bottom of cross arm 7 by one bolt into each curved slot 194 and 196. This allows rotational adjustment of knuckle plate 60 relative to cross arm 7 over the range of curved slots 194 and 196.

Round opening 182 at the mounting end of 180 of knuckle 50 fits around downwardly extending tube 192 on the bottom of knuckle plate 60. Bolts through bolt holes 184 and 186 of mounting end 180 of knuckle 50 extend into curved slots 194 and 196 in knuckle plate 60. This combination allows a range of rotational adjustment of knuckle 50 relative to knuckle plate 60 (over the range defined by curved slots 194 and 196 of knuckle plate 60). In this manner, there is some adjustability of knuckle 50 around a vertical axis, once knuckle plate 60 is mounted to the underside of cross arm 7.

Curved slot 188 in knuckle 50 provides a limit for pivoting of lamp cone 40 about knuckle 50. Knuckle 50 can therefore be used for aiming fixtures 10 to either side of cross arm 7. Additionally, lamp cone 40 can be set to a given aiming angle relative knuckle 50 as follows. An inside stop strap 142 can be fixed to boss 144 in the face of lamp cone 40. Inner and outer stop straps 146 and 148 can be bolted on opposite sides of curved slot 188 of knuckle 50 in a position so that when lamp cone 40 is rotationally adjusted relative to knuckle 50 for its intended aiming angle, inner and outer straps 146 and 148 would come into abutment with stop strap 142. Thus, the installer of the light system can have a factory-preset stop at the correct aiming angle for each fixture 10. This avoids individual aiming of each fixture when the system is installed at the field. Additionally, it allows easier maintenance. Bolt 174 holding lamp cone 40 to knuckle 50 can be loosened, lamp cone 40 and reflector frame 30 etc. can be swung down. Maintenance can be performed. Without realigning or re-aiming, the worker then only has to swing that reflector frame 30 etc. back up until it hits stop strap 142 and retighten lamp cone 40 to knuckle 50. Knuckle 50 can be die cast and removable mounted to die cast reflector frame 30 with gaskets or other structure to prevent leaks at that interface of parts.

Using the strap combination 146, 148 and stop strap 142 provides more holding power and withstands more torque than relying just on tightening of bolt 172.

C. Assembly and Use

In practice, a set of fixtures 10, such as described above, would be used in a sports lighting system customized for a particular sports field. Lighting specifications (usually including light quantity and uniformity minimums; and sometimes glare, spill, and halo light limitations) are usually prepared or known. As is well known in the art, computer software can design the lighting system, including what types of beams and beam shapes from how many fixtures at what locations are needed to meet the specifications. It can generate a report indicating number of fixtures, pole locations, beam types, and aiming angles to meet the design.

As described above, fixtures 10 can be assembled to produce a wide variety of beams and commonly used beam shapes for sports lighting. Using the report, a set of fixtures 10 can be pre-assembled at the factory. The appropriate reflector frame 30 for each beam type called for in the report can be pulled from inventory by the assembly worker.

Fixtures 10, a pole top with pre-assembled cross arms 7, and poles are shipped to the field to be lighted, along with aiming diagrams, showing how each pre-designed fixture should be aimed relative the field. The entire system, namely poles and bases for the poles, cross arms, fixtures, wiring, ballast boxes, etc. can substantially pre-assembled at the factory (see Musco U.S. Pat. No. 5,600,537, incorporated by reference herein). This pre-assembled system is available from Musco Corporation tinder the Light Structure™ brand name.

At ground level, knuckle plates 60 are attached to cross arms 7 and the appropriate fixture 10 is attached to its appropriate knuckle plate 60 by its knuckle 50 (after wiring for that fixture is connected to pre-wiring in cross arm 7). The knuckle for each fixture 10 is adjusted to match the indicated aiming for that fixture 10 according to an aiming diagram (using the pole as a reference point, as described later). Once aimed, the inner and outer knuckle straps and knuckle stop strap, are bolted in place so that the correct aiming position for the fixture is set. Any pivoting of fixture 10 above or below the reference position for arc tube 12 will result in automatic tilt factor correction movement of yoke 80 for that lamp 20.

The poles are erected vertically. Electrical power from a control cabinet is connected to each ballast box on each pole.

1. Fixture Aiming Methods

Accuracy of aiming is important with fixture 10 because the reflecting surfaces are so precise. Several methods are possible to improve reliability of aiming of fixtures 10.

One compensates for possible warpage of cross arm 7, e.g. during its manufacturing and welding (e.g. welding draw or galvanizing draw). Instead of basing the angle at which a lamp cone 40 is aimed relative to the cross arm 7, and risking it is not orthogonal (or is not in an orientation or shape assumed when designing the lighting system and the aiming of the fixtures) to the pole or to the ground because of warpage, aiming could be tied to a reference point unrelated to the cross arm. If the cross arm can be ignored, any error because of warpage of the cross arm is eliminated.

One method is to (a) assume the pole or pole top fitter is straight (it will then be straight up from earth when properly installed at the installation site; (b) attach the knuckle plates 60 to cross arms 7, (c) attach knuckles 50 to knuckle plates 60, (d) attach lamp cones 40 to knuckles 50, and (e) measure the absolute angle of the face of each knuckle 50 relative to the reference (e.g. the longitudinal axis of the pole) with a digital level or inclinometer. A zero alignment gauge, described below, is then mounted and adjusted relative to lamp cone 40, so any needed compensation will be built-in and the installer does not have to worry about any error caused by cross arm problems.

FIGS. 3A, B, and J, and 7A and B illustrate a zero alignment gauge 162. It is attachable to the side of cone 40 (see FIGS. 3A-J). A printed scale (each mark of the scale indicating one degree of pivoting of cone 40 relative to knuckle 50) can be cast or imprinted on knuckle 50.

Figure 1E:
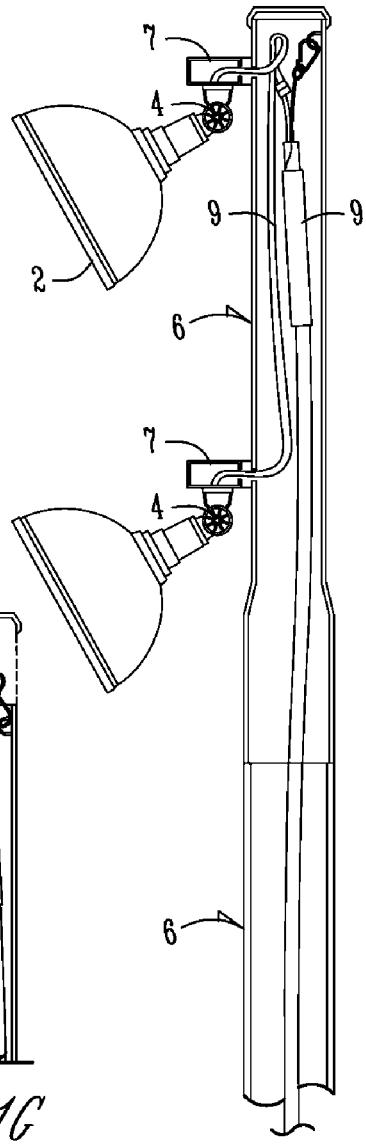
Figure 1F:
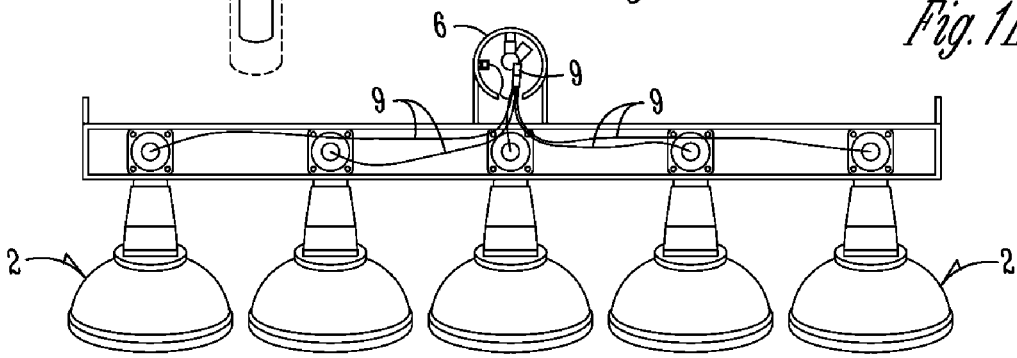

One embodiment of the invention would be as follows. At the factory knuckle plate 60 would be attached in position on a cross arm. Its corresponding knuckle 50 would be attached to knuckle plate 60 and its corresponding cone 40 would be attached to knuckle 50 by bolt 172. Cross arm would be attached to a vertical reference (a known vertical member. In this example, cross arm 7 would be attached to a pole top fitter such as indicated at FIG. 1E and it will be assumed that pole top fitter 6 is substantially straight and in a vertical position). A digital level or an inclinometer can be used to pivot cone 40 relative to knuckle 50 until the digital level or inclinometer informs the worker that the face of cone 40 is at a known reference position, not relative to knuckle 50 or cross arm, but rather relative to the assumed vertical pole fitter. The worker then knows cone 40 is at a known angle to vertical. The worker then pivotally adjusts zero alignment gauge 162 (which is pivotable over an approximate range of plus or minus 15 or 16°) until the witness mark along the center longitudinal axis of zero alignment gauge 162 is aligned with the "0" marking on the scale on knuckle 50. Gauge 162 can pivot left and right a few degrees (e.g. ±10°) in the plane of the page of FIG. 3B around its proximal end (the round-shaped key which is captured in the complementary slot formed in cone 40—see FIG. 3B). Gauge 162 can be locked or clamped in place over the range of potential pivoting by the screw through the small curved slot shown in FIG. 3B (the small slot defines the range of pivoting). Thus, the witness mark (the embossment, relief, or other mark) centered at the distal end of gauge 162 can be adjusted over that pivot range by loosening of the screw, and then locked in place relative cone 40 by tightening of the screw. The zero alignment gauge 162 is then fixed in position. It is conventional to then disassemble knuckle 50 and cone 40 from knuckle plate 60 and ship just the pole fitter (the removable top section of pole 6 with cross arms 7) with knuckle plate 60 in factor position to the installation site for the sports lighting system. Knuckle 50 and cone 40 would be connected to the remainder of the lighting fixture at the factor and shipped separately to the site. The worker then simply has to find from the lighting design information the aiming angle for the fixture, connect knuckle 50 to its corresponding knuckle plate 60 and pivot the fixtures so that the witness mark on the zero alignment gauge 162 matches the designated aiming angle on the scale on knuckle 50. Any concerns about miss-aiming because of warpage of cross arm has been compensated for because, at the factory, the witness mark relative to the scale on knuckle 50 had been calibrated relative to the assumed vertical (based on the longitudinal axis of the pole) instead of on relative knuckle 50, knuckle plate 60, or the cross arm.

Aiming of fixtures 10 needs to be relative to the target area. The assumption is many times made that the rugged metal cross arm 7 can be used as a reference relative to the ground. However, cross-arms can warp during the manufacturing process (e.g. from the high temperatures of welding during fabrication). Knuckle 50, therefore, may not be perfectly vertical when installed. The present method provides a more accurate and uniform frame of reference for aiming all fixtures on a pole, at the factory they can be referenced to the pole by attaching cross arm 7, knuckle plates 60 for each fixture, and knuckles 50 and cones 40 for each knuckle plate 60.

An alternative method is as follows. Each cone 40 can be hung straight down vertically relative to earth. Zero alignment gauge 162 can initially be fixed via a bolt or screw to lamp cone 40 such that its printed witness mark 163 (see FIG. 7A) is aligned with the longitudinal axis of lamp cone 40 or other reference position. The scale (e.g. equally spaced marks, each a fraction of an inch apart) can be printed (e.g. with ink jet printer) on knuckle 50 in a position so that the witness mark of zero alignment gauge 162 would indicate zero if both were aligned vertically relative to earth. If the witness mark does not align with the zero position on knuckle 50, it will indicate some sort of warpage or irregularity in the cross arm. The amount of irregularity will be quantified by the offset of the witness mark from knuckle zero position. Zero alignment plate 162, can then be loosened and rotated to line up the witness mark with the zero position. Thus, compensation for cross arm warp age is accomplished. At installation of the fixtures, the compensation has occurred and the worker can assume the witness mark lined up with the knuckle zero position mark is the starting reference point for aiming. FIGS. 3J and 6D show gauge 162 and how it can indicate relative angular position between cone 40 and knuckle 50.

As can be seen, the exemplary embodiment of the invention compensates for cross arm warpage or other anomaly that could effect aiming of a fixture or an array of fixtures. It can be appreciated that the invention can take many forms and embodiments. The foregoing description is but one way the invention can be practiced. Variations obvious to those skilled in the art will be included within the invention, which is described solely by the appended claims.

Therefore, as can be appreciated from the foregoing, by utilizing a reference other than the cross arm, potential error could be introduced by the cross arm not being orthogonal to the pole, or being warped along its length, is addressed.

The foregoing example describes factory calibrating the adjustability for aiming of the fixture in a vertical plane (the tilting of the fixture in a vertical plane to a predesignated downward aiming angle). The method also can apply analogously to factory calibrating adjustment of each fixture in the horizontal direction (a panning direction). Knuckle plate 60 could be preliminarily attached to the bottom of a cross arm instrumentation or other methods could be used to align it with a reference horizontal axis other than relying on any part of the cross arm. The correct alignment of knuckle plate 60 to that external reference would then be marked or indicated and a zero position set relative to a scale. The worker at the installation site then simply rotates the fixture in the panning direction until that calibrated zero witness mark lines up with the designated panning angle for the fixture.

What is claimed is:

1. A method for compensating for warpage or other variations in a cross-arm on a pole adapted for the mounting of lighting fixtures at pre-determined aiming angles relative to a target space and a cross-arm by setting angular position of a fixture relative the cross-arm to the predetermined aiming angle comprising:

a. determining the pre-determined aiming angle for a fixture relative to its cross-arm;

b. assigning a normative reference position for the mounting structure relative its cross-arm;

c. assigning a pole reference position defined by a geometry of the pole and having a known relationship to an ideal normative reference position;

d. mounting the fixture or part thereof to its cross-arm by the adjustable mounting structure at its actual position;

e. comparing the actual position relative to the pole reference position; and f. setting the actual aiming angle of the fixture to its predetermined aiming angle relative the actual position adjusted by any offset between the normative reference position and the pole reference position.

2. The method of claim 1 wherein the lighting fixtures are sports lighting fixtures or large area lighting fixtures.

3. The method of claim 2 wherein sports lighting fixtures comprise a plurality of fixtures one or more cross arms mountable relative to a pole.

4. The method of claim 1 wherein the pre-determined aiming angles are a part of a pre-determined lighting plan.

5. The method of claim 4 wherein the lighting plan includes aiming points to a target area for each light fixture.

6. The method of claim 5 wherein the aiming points assume a mounting height and position of the light fixture and an aiming orientation of the light fixture relative to the aiming point.

7. The method of claim 6 wherein the aiming orientation of the light fixture is adjustable relative to the cross arm.

8. The method of claim 7 further comprising providing an installer with directions for orienting the light fixture relative the cross arm when installing the lighting system.

9. The method of claim 8 further comprising indicia on the lighting fixture and the cross arm to assist in setting the fixture to the pre-determined aiming orientation.

10. A method for compensating for warpage or other variations in a cross arm on a pole adapted for mounting of at least one light fixture of pre-determined aiming angle relative to a target space on an adjustable mounting structure comprising;

a. designing an aiming orientation for a light fixture assuming a geometrical relationship between at least one axis or surface of the cross arm to between at least one axis or surface of a pole or other reference;

b. checking the actual geometrical relationship of the at least one axis or surface of the cross arm to the at least one axis or surface of the pole or other reference when the cross arm is mounted to the pole;

c. noting any offset between the assumed geometric relationship and the actual geometric relationship; and d. compensating for any offset when installing and aiming the light fixture on the cross arm.

11. The method of claim 10 further comprising quantifying the offset relative to a reference or zero position.

12. The method of claim 11 wherein the quantifying comprises an indicia or gauge on one or more of the cross arm and lighting fixture which can establish a reference position between orientation of the lighting fixture and the cross arm, and which can be used to quantify any offset.

13. The method of claim 12 further comprising using the indicia or gauge to set a reference position at the factory and using the reference indicia or gauge to check for offset.

14. The method of claim 13 wherein the indicia or gauge includes a scale.

15. The method of claim 14 wherein the step of checking for offset comprises comparing the factory reference position with orientation of the fixture relative to vertical or horizontal.

16. A method of aiming a lighting fixture having a mounting structure allowing adjustable pivoting in at least one plane when mounted along a cross arm connected to a pole or pole fitter comprising:

a. preliminarily installing the mounting structure for the fixture to the cross arm, b. adjustably pivoting the mounting structure to a reference position related to a predetermined reference axis or plane other than an axis, plane, or surface of the cross arm, c. verifying the mounting structure is in the reference position, d. marking the reference position on the mounting structure or cross arm, and e. adjustably pivoting the mounting structure to a predetermined aimed position in relation to the marked reference position.

17. The method of claim 16 wherein the mounting structure comprises a knuckle and a lamp cone.

18. The method of claim 17 wherein the marking is a pivotably adjustable plate on the lamp cone.

19. The method of claim 18 further comprising a scale placed on the knuckle indicating degrees of angular orientation between the knuckle and lamp cone from the marked reference position.

* * * * *